US007406739B2

(12) United States Patent
Guest et al.

(10) Patent No.: US 7,406,739 B2
(45) Date of Patent: Aug. 5, 2008

(54) GROUT TOOL FOR USE WITH AN ALL SURFACE CLEANING APPARATUS

(75) Inventors: Michael Guest, Morrison, CO (US); Roger Pedlar, Golden, CO (US); Brian J. Doll, Denver, CO (US)

(73) Assignee: Karcher Floor Care, Inc, Englewood, CO (US)

( * ) Notice: Subject to any disclaimer, the term of this patent is extended or adjusted under 35 U.S.C. 154(b) by 236 days.

(21) Appl. No.: 11/253,924

(22) Filed: Oct. 18, 2005

(65) Prior Publication Data

US 2006/0037171 A1 Feb. 23, 2006

Related U.S. Application Data

(62) Division of application No. 10/438,485, filed on May 14, 2003, now abandoned.

(51) Int. Cl.
*A46B 11/06* (2006.01)

(52) U.S. Cl. ..... 15/49.1; 15/50.1; 401/268; 401/285

(58) Field of Classification Search ..... 15/302, 15/320, 321, 49.1, 50.1; 401/139, 268, 285
See application file for complete search history.

(56) References Cited

U.S. PATENT DOCUMENTS

| | | | | | |
|---|---|---|---|---|---|
| 180,985 | A | * | 8/1876 | Britwhistle | 401/284 |
| 361,584 | A | * | 4/1887 | Flower | 401/284 |
| 371,515 | A | * | 10/1887 | Nowotny | 401/137 |
| 828,705 | A | * | 8/1906 | Bode | 401/284 |
| 854,151 | A | * | 5/1907 | Deasy | 401/284 |
| 1,132,449 | A | * | 3/1915 | Cox | 401/139 |
| 2,801,431 | A | * | 8/1957 | Eastis | 15/29 |
| 2,975,463 | A | * | 3/1961 | Morris | 401/137 |
| 3,110,055 | A | * | 11/1963 | Merrill | 401/48 |
| RE25,939 | E | * | 12/1965 | Krammes | 15/320 |
| 3,322,350 | A | | 5/1967 | Heinicke | |
| 3,504,858 | A | | 4/1970 | Liddiard | |
| RE26,950 | E | | 9/1970 | Hays | |
| 3,705,437 | A | | 12/1972 | Rukauina, Jr. et al. | |
| 3,797,744 | A | | 3/1974 | Smith | |
| 3,883,301 | A | | 5/1975 | Emrick et al. | |

(Continued)

FOREIGN PATENT DOCUMENTS

| | | |
|---|---|---|
| CA | 2242793 | 5/1999 |

(Continued)

OTHER PUBLICATIONS

Fantomat Sale Sheet, Buzili-Werk Wagner GmbH & Co.

(Continued)

*Primary Examiner*—Frankie L Stinson
(74) *Attorney, Agent, or Firm*—Sheridan Ross P.C.

(57) ABSTRACT

The present invention relates to an improved grout tool generally employed with a multi-functional surface cleaning machine having a fluid tank, a pump, and at least one receptacle for holding concentrated cleaning chemicals. In one embodiment, the grout tool employs fluid jets, adjustably connected via brackets, such that the jets are positioned at an angle relative to the grout tool body to allow fluid to hit a surface of an angle.

8 Claims, 19 Drawing Sheets

U.S. PATENT DOCUMENTS

| | | | | | |
|---|---|---|---|---|---|
| 3,981,596 | A | * | 9/1976 | Melton | 401/48 |
| 4,019,218 | A | | 4/1977 | Cyphert | |
| 4,046,321 | A | | 9/1977 | Hewett | |
| 4,069,541 | A | | 1/1978 | Williams et al. | |
| 4,075,733 | A | | 2/1978 | Parise et al. | |
| 4,083,077 | A | | 4/1978 | Knight et al. | |
| 4,135,669 | A | | 1/1979 | Bridges et al. | |
| 4,200,952 | A | | 5/1980 | Smies et al. | |
| 4,200,953 | A | | 5/1980 | Overton | |
| 4,218,900 | A | | 8/1980 | Caplan et al. | |
| 4,237,576 | A | | 12/1980 | Stakes | |
| 4,307,484 | A | * | 12/1981 | Williams | 15/321 |
| 4,329,756 | A | * | 5/1982 | Chicoine et al. | 15/321 |
| 4,458,377 | A | | 7/1984 | Frohbieter | |
| 4,527,739 | A | * | 7/1985 | Parma et al. | 239/752 |
| 4,596,061 | A | * | 6/1986 | Henning | 15/322 |
| 4,718,140 | A | | 1/1988 | Johnson | |
| 4,773,113 | A | | 9/1988 | Russell | |
| 4,821,958 | A | | 4/1989 | Shaffer | |
| 4,879,784 | A | | 11/1989 | Shero | |
| 4,897,784 | A | | 1/1990 | Nay | |
| 4,920,997 | A | | 5/1990 | Vetter et al. | |
| 4,991,254 | A | | 2/1991 | Roden et al. | |
| 5,075,921 | A | | 12/1991 | Gleadall | |
| 5,157,805 | A | * | 10/1992 | Pinter | 15/322 |
| 5,167,805 | A | | 12/1992 | Theiss | |
| 5,174,730 | A | | 12/1992 | Nieuwkamp et al. | |
| 5,217,166 | A | | 6/1993 | Schulze et al. | |
| 5,221,026 | A | | 6/1993 | Williams | |
| 5,383,605 | A | | 1/1995 | Teague | |
| 5,517,805 | A | * | 5/1996 | Epstein | 53/453 |
| 5,555,595 | A | | 9/1996 | Ligman | |
| 5,797,161 | A | | 8/1998 | Campbell | |
| 5,898,970 | A | | 5/1999 | Stralton | |
| 6,023,813 | A | | 2/2000 | Thatcher et al. | |
| 6,158,673 | A | | 12/2000 | Toetschinger et al. | |
| 6,206,980 | B1 | | 3/2001 | Robinson | |
| 6,220,527 | B1 | * | 4/2001 | Chen et al. | 239/532 |
| 6,250,831 | B1 | * | 6/2001 | Craven | 401/139 |
| 6,266,892 | B1 | | 7/2001 | Haynie | |
| 6,283,170 | B1 | | 9/2001 | Robinson | |
| 6,367,120 | B2 | | 4/2002 | Beauchamp | |
| 6,413,002 | B1 | * | 7/2002 | Delaine, Jr. | 401/289 |
| 6,425,958 | B1 | | 7/2002 | Giddings et al. | |
| 6,431,217 | B2 | | 8/2002 | Robinson | |
| 6,453,506 | B1 | | 9/2002 | Sumner | |
| 6,533,871 | B2 | | 3/2003 | Zahuranec et al. | |
| 6,554,207 | B2 | | 4/2003 | Ebberts | |
| 6,585,827 | B2 | | 7/2003 | Field et al. | |
| 6,647,585 | B1 | | 11/2003 | Robinson | |
| 6,671,925 | B2 | | 1/2004 | Field et al. | |
| 6,684,452 | B2 | | 2/2004 | Lehman et al. | |
| 6,705,332 | B2 | | 3/2004 | Field et al. | |
| 6,721,990 | B2 | | 4/2004 | Zahuranec et al. | |
| 6,735,811 | B2 | | 5/2004 | Field et al. | |
| 6,735,812 | B2 | | 5/2004 | Hekman et al. | |
| 6,789,290 | B2 | | 9/2004 | Kent et al. | |
| 6,918,156 | B2 | | 7/2005 | Joo et al. | |
| 6,935,579 | B1 | * | 8/2005 | Lindsey | 239/530 |
| 6,941,614 | B2 | | 9/2005 | Montgomery | |
| 6,945,261 | B2 | | 9/2005 | Wadsworth et al. | |
| 6,981,338 | B2 | | 1/2006 | Jensen et al. | |
| 7,048,805 | B2 | | 5/2006 | Kent et al. | |
| 2002/0157209 | A1 | | 10/2002 | Marshall et al. | |
| 2003/0159225 | A1 | | 8/2003 | Kuo | |
| 2003/0192963 | A1 | | 10/2003 | Ebberts | |
| 2004/0040102 | A1 | | 3/2004 | Field et al. | |
| 2004/0154124 | A1 | | 8/2004 | Lehman et al. | |
| 2004/0187895 | A1 | | 9/2004 | Field et al. | |
| 2004/0221407 | A1 | | 11/2004 | Field et al. | |
| 2004/0255413 | A1 | | 12/2004 | Peters et al. | |

FOREIGN PATENT DOCUMENTS

| | | |
|---|---|---|
| DE | 1023867 | 2/1958 |
| DE | 1270066 | 6/1968 |
| DE | 1658384 | 4/1971 |
| DE | 19539350 | 4/1997 |
| DE | 10029691 | 1/2002 |
| DE | 10030725 | 1/2002 |
| DE | 10062329 | 7/2002 |
| DE | 10142192 | 3/2003 |
| DE | 10204118 | 10/2003 |
| DE | 10218244 | 11/2003 |
| DE | 10221349 | 11/2003 |
| DE | 10221351 | 11/2003 |
| DE | 10221352 | 11/2003 |
| DE | 10324825 | 12/2004 |
| DE | 10324826 | 12/2004 |
| EP | 0176696 | 4/1986 |
| EP | 0176697 | 4/1986 |
| EP | 0792615 | 9/1997 |
| EP | 1260129 | 11/2002 |
| EP | 1265713 | 12/2002 |
| EP | 1335869 | 8/2003 |

OTHER PUBLICATIONS

Karcher, MC600 Multicleaner Brochure, date unknown, 2 pages.
Karcher, MC600 Multicleaner Brochure, date unknown, 4 pages.
Karcher, Multicleaner MC 600, Mar. 1990, 7 pages.
Karcher, Multicleaner MC600 Manual, date unknown, 44 pages.
Karcher, NT301 Brochure, date unknown, 2 pages.
Karcher, Worldwide Cleaning Expertise Programme 91/92, published more than one year prior to the filing date of U.S. Patent 6,425,958, which was filed Feb. 2001, 49 pages.
Nobles Typhoon 161OP-1612 Wet/Dry Vacuum Operator and Parts Manual, Jan. 2000, 22 pages Kaivak, Inc.
No-Touch Cleaning Brochure, Kaivac, Inc., dated 2003, 8 pages.
Print out of Kaivac No-Touch Clean System, www.Kaivac.com, dated Jan. 23, 2003, 3 pages.
Print out of Nilfisk Aquatron 8 machine, www.mn.nilfisk-advance.com, dated Jan. 30, 2003, 1 page.
ServiceMaster Carpet Care 2000 Boss 2000B Operator & Parts List Manual, (Oct. 1995), 45 pages.
Service Master, Boss 2000E Manual, Aug. 1997, 32 pages.
Service Master, Boss 2000LE Manual, Mar. 1998, 30 pages.
Warning: Your Competitor has a KaiVac, Sep. 1998, 10 pages.
International Search Report for International (PCT) Patent Application No. PCT/US04/39800, mailed Sep. 9, 2005.
Written Opinion for International (PCT) Patent Application No. PCT/US04/39800, mailed Sep. 9, 2005.
International Preliminary Report on Patentability for International (PCT) Patent Application No. PCT/US04/39800, mailed Jun. 20, 2006.

* cited by examiner

SECTION B-B

SECTION A-A

GROUT TOOL FOR USE WITH AN ALL SURFACE CLEANING APPARATUS

This application is a divisional of U.S. patent application Ser. No. 10/438,485, filed May 14, 2003 now abandoned, which is incorporated by reference in its entirety herein.

FIELD OF THE INVENTION

Cleaning machines are used extensively for cleaning the surfaces of sinks, urinals, toilets, windows, shower stalls, tiles, stone, brick, locker rooms, swimming pool areas, carpets, vents and other surfaces. Maintaining the cleanliness of these surfaces, especially in high volume areas in commercial, industrial, institutional and public buildings is an ongoing and time consuming process. The present inventions relate generally to this field and are directed to a multi-functional cleaning machine which is useful in cleaning such surfaces, components and features thereof, and methods for efficiently and productively using such cleaning machines.

BACKGROUND OF THE INVENTION

Building maintenance staff and others often clean dirty surfaces, such as restroom floors, using traditional mop and bucket assemblies. The bucket may include a detachable mop ringer and may be positioned on caster wheels to facilitate easy movement. Depending on the cleanliness of the equipment, a worker may be able to make a good start in cleaning a floor using the mop and bucket approach. However, soon the mop and fluid in the bucket becomes soiled or otherwise contaminated by such as germs and bacteria. From that point on, each time the worker plunges the mop into the bucket and rings the mop, both the mop and cleaning fluid become more and more dirty/contaminated. In the end, a dirty surface gets "cleaned" by pushing dirty and potentially disease or germ contaminated water over the surface to be cleaned with a dirty and/or contaminated mop. In short, the surface remains wet with contaminated solution.

These basic cleaning problems have generally been addressed by provision of a multi-functional cleaning machine, such as the machine disclosed in U.S. Pat. No. 6,206,980 to Robinson, entitled "Multi-functional Cleaning Machine," which is fully incorporated herein by reference. This type of cleaning machine generally includes a wheeled body with two tanks, one concentrated chemical receptacle, a vacuum and blower motor, and a fluid pumping system. Typically, such equipment includes only a single motor used for both vacuuming and blowing. Such a motor may include an air intake and an air outlet. The cleaning equipment also generally includes a tube connectable to either the air outlet or air inlet of that motor. When connected to the air outlet, air is forced down the tube for use in blow drying surfaces. When connected to the air inlet, a vacuum is created inside the tube, facilitating suctioning of fluid, which is generally dirty/contaminated, from the surface. In either case, however, the blower motor is always fixedly secured to and/or incorporated into the cleaning machine.

One of the tanks of these prior art machines is used to hold a base cleaning fluid, such as water, into which concentrated cleaning chemicals may be injected to create a cleaning solution. Thereafter, the cleaning solution may be pumped, via an appropriate hose or tubing, to any number of cleaning implements for supply to the surface to be cleaned, such as a pressure spray gun, a cleaning wand, etc. The pumping operation can be performed at either a relatively high or low pressure, depending upon the cleaning application and the fluid pump employed in the machine. The cleaning solution may be worked into the surface to be cleaned to release and then entrain dirt and debris deposited on the surface being cleaned. Next, dirty cleaning solution can be vacuumed, again via an appropriate vacuum hose, into the second tank, generally referred to as a recovery tank. Finally, a blower motor can supply pressurized air, typically through the vacuum hose, to dry the now cleaned surface.

Obviously, the use of one vacuum blower motor and related tube creates a cleanliness problem similar to the problems created by use of a mop and bucket. Contaminants that are vacuumed through the hose and motor may become stuck to the motor and hose inner walls, etc. When that same equipment is used to blow dry a surface, the contaminants may become dislodged from the hose and motor and be deposited back onto the cleaned surface. For this reason, known prior art systems often facilitate spreading of germs and other contaminants. These problems were somewhat addressed by providing a surface cleaning machine having separate blower motor and vacuum motor assemblies. Such a cleaning machine is disclosed in U.S. Pat. No. 6,425,958 to Giddings et al., which is fully incorporated herein by reference. While these later surface cleaning machines have advanced beyond the single blower and vacuum motor cleaning approach, they still have significant shortcomings.

One shortcoming is the manner in which a cleaning solution is created. The prior art devices do not provide for one of multiple concentrated cleaning chemicals to be easily added to a base fluid (e.g., water) or to properly provide precise amounts of desired chemicals to the base fluid to create a desired cleaning solution. Further, these prior art devices add concentrated cleaning chemicals to a base fluid through a process of injection, which can create unwanted pressures in the overall system, potentially causing not only system failure, but hazards to system users. Use of injectors also adds componentry to the equipment, thereby increasing both cost and weight of the equipment.

A second shortcoming of the known devices is the manner in which concentrated cleaning chemicals are stored upon those machines. Known cleaning machines allow receptacles of concentrated cleaning chemicals to be placed upon the cleaning machine in a completely unsecured and unprotected fashion. The cleaning chemicals can thus be stolen or tampered with, or the cleaning chemical receptacle may easily be damaged or spilled. Obviously, any of these situations is not desired and is potentially very dangerous not only to the public at large, but also to the user of the equipment.

A third shortcoming of known cleaning machinery relates to the blower used to dry and/or clean, etc., a surface. Prior art blowers are fixedly secured or otherwise incorporated into cleaning machinery. Accordingly, use of these blowers is limited to the general location of that machinery and generally may not be used if other componentry is in use, such as the vacuum assembly. Obviously, hoses can be used to extend blower reach, but such hoses are expensive, utilize limited storage space, add weight to the overall machine and generally decrease the effectiveness of the blower.

A further shortcoming of known prior art devices is that they do not provide a ergonomically efficient or easily regulatable system for applying a pressurized cleaning solution to a surface. It is often desirable or necessary when cleaning a surface to apply a cleaning solution to the surface with force. Such is accomplished by known machines through use of a spray gun which uses pressurized cleaning or other solution. However, in these prior art devices, the pressure at which the cleaning solution is supplied to the gun is not easily regulatable throughout a range of pressures and certainly not regulatable at the gun itself. Moreover, prior art spray guns do not include attachments, such as a lance wand adapted to provide comfortable use of the gun in at least several typical surface cleaning applications. Instead, ergonomically unsound lance wands are used, which tend to fatigue the equipment user more readily than is necessary or desired.

Another drawback of known prior art cleaning machines is the use of vacuum hoses that need to be wound and stored within the machine. Use of such hoses not only monopolizes space, which is in short supply on a compact cleaning machine, but also wastes operator time. Accordingly, there is a need to develop and incorporate into compact cleaning machines a vacuum hose which need not be wound, i.e., self-retracting, for purposes of storage.

Another drawback of known cleaning machines relates to the vacuum and solution extension wand, which may be used with the machinery and into which various cleaning tools may be attached. Such tools include: a squeegee for recovering spent cleaning solution from a hard floor; a dry pickup for recovering dirt and debris (i.e., traditional vacuuming application) from both hard and soft floors; a carpet sprayer and extractor tool for applying and recovering cleaning solution; and a grout tool for providing cleaning solution to a grouted hard floor or similar surface via specialized pressure jets and a brush and vacuum assembly to complete the cleaning process, etc. Unfortunately, these prior art wands do not facilitate quick and easy removal and replacement of all available tools which is obviously problematic for the user of such equipment.

There is also a need for an improved grout tool for use with prior art cleaning machines. Known grout tools do not provide adequate adjustability or positioning of a cleaning solution spray jet. Also, reliance on a single jet, as opposed to multiple jets, minimizes the productivity and effectiveness of the tool. Due to these shortcomings, known tools do not adequately clean soiled grouted surfaces.

Another problem with known cleaning machines is the failure to provide a work station environment, including poor placement of machine controls, tools and hoses. In such machines, the controls for activating or adjusting pumps, motors, valves, injectors, etc., are located in a position that is inconvenient for a user. In these machines, tools are also scattered around the machine, i.e., they are not concentrated in any particular area of the machine. Moreover, tools which come into contact with fluid are often stored on prior art machines in such a way as to facilitate dripping of fluids back onto a clean surface. Obviously, this is not advantageous. Thus, there is a need to provide a cleaning machine that provides a work station environment, including placing the tools and controls in a position on the device that is convenient for use by the operator when the machine is in use. Such ergonomically friendly placement of controls, tools and hoses will not only facilitate usability of the machine, but will also increase productivity of the user of that machine.

Finally, known cleaning machines do not provide adequate onboard storage for carrying needed cleaning supplies, tools, etc. Likewise, known machines do not provide a flexible approach to adding storage facilities for trash and the like when the need for such arises. Machinery that addresses these issues is therefore needed.

SUMMARY OF THE INVENTION

The present inventions relate to methods of cleaning surfaces and devices used therein. The inventive cleaning equipment includes a fluid housing and a base. Within the base is a fluid pump assembly and a vacuum assembly. The device further includes two tanks, one for retaining a base cleaning fluid, such as water, and a second for retaining spent cleaning solution, both of which are housed in the fluid housing. The inventive machine also includes one or more concentrated cleaning chemical receptacles designed to hold concentrated cleaning chemicals. The receptacles are stored on the machine within a lockable structure, adding safety to the overall machine.

In operation, fluid from the chemical receptacles flow through a tube to a chemical selector, which can include a metering valve. The selector has a positive shut-off position. When in that position, fluid is not allowed to flow through the selector regardless of the fluid pressure in a fluid line. That selector is responsive to input from the operator to select one of the several cleaning chemicals. Once a chemical is selected, it is free to flow through the chemical selector and appropriate amounts thereof may be provided to one of any number of inlets to a mixing tee. The amount of chemical allowed to flow can be adjusted by a metering valve built into the selector or separate from the selector, in a known fashion. A base cleaning fluid, such as water, may flow from the fluid tank and through a separate tube to a second leg of the mixing tee. The cleaning fluid and concentrated cleaning chemical then mix within the mixing tee to create a cleaning solution. That solution may then be passed through the selector outlet to a pressure pump, when the cleaning solution may be pressurized and communicated via appropriate tubing to a spray gun. The pump, which draws fluid to and through the selector, also preferably may include a bypass system to facilitate regulation of pump pressure. Use of the pump to draw fluid is preferred as it does not create unwanted pressures in the fluid lines.

A solution can be applied to a surface to be cleaned using the spray gun. It is well known in the art that such surfaces readily include hard surfaces such as tile and toilets. However, the preferred machine also has great utility in cleaning carpeted surfaces. In a preferred embodiment, the spray gun or associated solution lines or tubes include an adjustable valve, which may be used to adjust the pressure and flow of solution allowed to exit the spray gun. Because of the adjustability, the machine can be utilized as a pre-sprayer for various carpet treatments, including spotting or other treatments. As the preferred machine can provide clean water, multiple chemicals or combinations thereof, it can also be used as an application device of extraction chemicals or rinse fluids to a carpeted surface.

By use of the chemical selector, two or more receptacles of cleaning chemicals can easily be fluidly connected to a mixing tee. By this arrangement, a user of the machine can create any number of cleaning solutions without the need for adding receptacles or switching chemical feed lines from one receptacle to another or without changing metering tips that can easily become lost or confused. Instead, all that needs to be done is the selection of a desired chemical through use of the selector. The less cleaning chemicals are handled, the safer the cleaning process. Similarly, use of a metering valve will allow a user to create a very precise cleaning solution.

It is preferred that one-way check valves be used throughout the system. For instance, check valves can be included in: delivery lines that supply cleaning chemicals to the mixing tee; lines that supply water to the mixing tee; lines that supply cleaning solution to the pump; lines that supply cleaning solution to the spray gun; or in the mixing tee, itself. The check valves prevent reversal of fluid and prevent contamination of one fluid with another.

The inventive cleaning machine also includes a modular blower assembly. The blower assembly may be hand-held and operate completely apart from the overall cleaning machine. The blower assembly can be used to dry areas physically separate from where the machine may be stored. Because the blower assembly is separate from the machine, it may also be used for other blowing functions, such as blowing leaves, grass, dirt or other debris. The blower assembly can be used with a detachable hand nozzle, a flexible nozzle, an extension wand, etc., thereby increasing the overall flexibility of the blower assembly. As the blower assembly is modular, it may be utilized separately from the machine or with the machine, as desired. The blower assembly may utilize an integrated on/off switch and be powered by electricity supplied by any typical extension cord, including a cord that supplies current to the cleaning machine. It may also be that if the cleaning machine is battery powered, that a cord attached at one end to the battery power may be supplied to the blower assembly. The blower may be configured to be stored on the cleaning machine in one of any number of convenient ways. It should be appreciated that having a modular blower assembly of this type is very beneficial to the overall functionality of a multi-functional cleaning machine and related process.

Another aspect of the inventive cleaning machine relates to an ergonomically enhanced spray gun, having the capability of infinite adjustability of the pressure of fluid to be dispensed through the spray gun nozzle. Such a gun allows a user to vary the pressure of cleaning solution or other fluid exiting the gun by adjusting a variable pressure reduction valve mounted on or near the gun itself. Provision of various pressure and flow at the gun also saves cleaning solution and can act as a safety feature as the machine operator can efficiently manipulate cleaning fluid pressures while he or she is actually working with the device. A variable spray gun is also useful in carpet cleaning operations as it can be used as a carpet extractor pre-cleaning device. The gun may also include a lance wand which has a curvature at its end. Such curvature provides an ergonomically superior wand to clean floors, toilets, etc., as it allows the operator to clean hard to reach surfaces.

A further inventive aspect of the cleaning machine is the use of a self-retracting vacuum hose. The inventive hose compresses when not in use, making it unnecessary to wind the hose around a retaining structure formed on, in, or near the cleaning machine for storage. When in use, the hose expands to many times its compressed length, providing an operator with substantial operating mobility. Not only does use of such a retractable vacuum hose save an operator time (i.e., no need to wind a hose), it also saves space on the cleaning machine and reduces trip hazards, as it only expands to a length necessary for a given job—excess hose is, thus, not left on the floor creating hazardous situations.

A further inventive aspect of the present cleaning machine is a modular vacuum extension wand. The modular wand is similar to known wands, except that it utilizes a cleaning solution transport tube and valve which terminates in a coupling device located just above a terminal end of the wand. Tools which utilize cleaning solution, such as carpet spray and extraction and grout tools, can include an onboard cleaning solution tubing terminating in a device capable of quickly attaching to the coupling device located on the wand itself. Attaching spray jets to the tool, instead of the wand, means that the correct pressure and spray patterns may always be used and a wide variety of various cleaning tools can thus quickly and easily be attached to the inventive modular extension wand, facilitating cleaning operations and saving operator time.

Another inventive aspect of the present invention is an improved grout tool. The tool provides for spray jets to be attached to the tool body, in an adjustable fashion via brackets, and fluid to be applied to the cleaning surface at an angle. More specifically, the spray of cleaning solution from the grout tool jets hits the surface to be cleaned at an angle, forcing the cleaning solution into a cleaning brush, also carried on the tool body. The brush, in combination with the jet spray of cleaning solution, works dirt and debris loose from the surface being cleaned. Once loose, the debris is vacuumed into the recovery tank through a vacuum chamber formed in the grout tool body and hose.

A further inventive aspect of the present machine is that it utilizes a work station environment. The machine naturally has a front and back. An operator may properly push the machine, which utilizes large wheels in both the front and the back, by applying pressure to a handle found at the back of the machine. Once at an area to be cleaned, the operator typically moves to the machine front. Once in the front, the operator may lock caster wheels to keep the machine from moving while the operator is working and may select appropriate cleaning tools and supplies for the cleaning job at hand. Controls necessary for operating the machine are conveniently located on a panel secured to the front of the machine and thus easily accessible to the operator (i.e., cleaning professional). In this way, the cleaning professional can set the machine controls at about the same time he or she is collecting the necessary cleaning supplies and tools, saving time and making the cleaning process more efficient. Moreover, the inventive machine utilizes a drip pan, which is incorporated into the base. The drip pan is configured to catch any fluids that might be expelled from any cleaning tool used by the machine operator which comes in contact with fluid.

Another aspect of the inventive cleaning machine is the inclusion of bins, trays, bays and other storage devices at the machine front, again within easy reach of the cleaning professional. These bins provide the cleaning professional with substantial flexibility when cleaning a large building or area that has many types of surfaces that may need cleaning. Also, the present cleaning machine provides for modular trash/supply bins which can be added to or removed from the machine quickly and easily so that the machine can be configured for one of any number of cleaning activities.

Various aspects of the inventions discussed briefly above combine to provide an effective and efficient cleaning tool, useful in cleaning numerous areas in and around commercial, industrial, institutional and public buildings. Moreover, due to the various aspects of the present invention, a sanitation maintenance worker may clean a particular room or facility more efficiently than previously possible.

These and other benefits and advantages of the invention will be made apparent from the accompanying drawings and description of the drawings, as well as a detailed description of those drawings and the inventions disclosed herein.

BRIEF DESCRIPTION OF THE DRAWINGS

The accompanying drawings which are incorporated in and constitute a part of the specification, illustrate embodiments of the invention and together with the general description of the invention given above and the detailed description of the drawings given below, serve to explain the principles of these inventions.

Figure 1B:
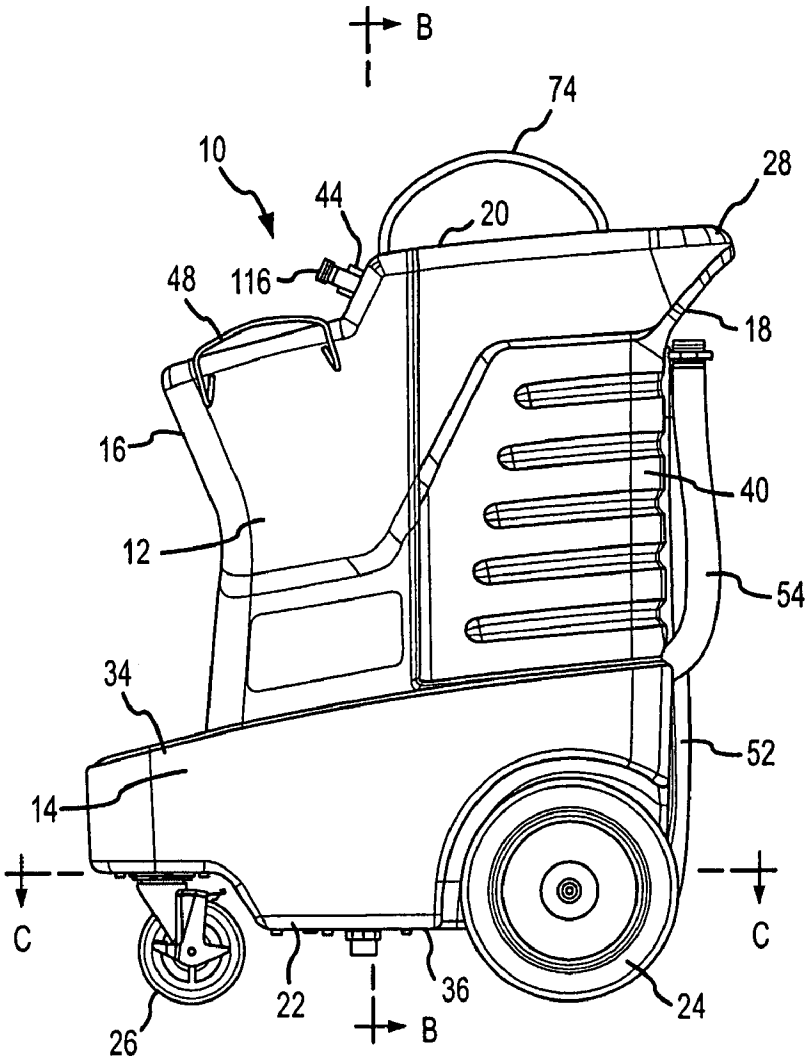
FIG. 1*b* is a side view of one embodiment of a preferred multi-functional cleaning machine.

The following components and numbers associated thereto are shown in the drawings and provided here for ease of reference:

| # | Component |
|---|---|
| 10 | multi-functional cleaning machine |
| 12 | fluid housing |
| 14 | base |
| 16 | machine front |
| 18 | machine back |
| 20 | machine top |
| 22 | machine bottom |
| 24 | rear wheels |
| 26 | front wheels |
| 28 | pushing handle |
| 30 | vacuum motor |
| 32 | fluid pump |
| 34 | drip pan |
| 36 | mounting plate |
| 38 | base fluid tank |
| 40 | recovery tank |
| 42 | lockable enclosure |
| 44 | control panel |
| 46 | storage bin |
| 48 | pressure hose retainer |
| 50 | base fluid tank outlet |
| 52 | fluid level indicator |
| 54 | dirty fluid dump tube |
| 56 | retaining plate |
| 58 | cover plate |
| 60 | retaining plate hook |
| 62 | retaining plate slot |
| 64 | cover plate projection |
| 66 | projection tab |
| 68 | cover plate apertures |
| 70 | chemical storage receptacles |
| 72 | selector and metering valve |
| 74 | receptacle to selector tubing |
| 76 | selector fluid inlets |
| 78 | selector fluid outlet |
| 80 | rotary valve |
| 82 | knob |
| 84 | screw and washer |
| 86 | cap |
| 88 | retaining nut |
| 90 | tubing |
| 91 | check valve |
| 92 | mixing tee |
| 94 | mixing tee inlets |
| 96 | mixing tee outlet |
| 98 | base fluid tube |
| 100 | solution check valve |
| 102 | filter |

-continued

| # | Component |
|---|---|
| 104 | tube |
| 106 | pump inlet |
| 108 | pump outlet |
| 110 | bypass line |
| 112 | bypass valve |
| 114 | high pressure hose |
| 116 | high pressure hose quick connect coupling device |
| 118 | second high pressure hose |
| 120 | spray gun |
| 121 | spray gun trigger |
| 122 | female quick connect coupling device |
| 124 | male quick connect coupling device |
| 126 | lance wand |
| 128 | spray jet |
| 130 | variable pressure reduction valve |
| 132 | wand curvature location |
| 134 | vacuum motor inlet |
| 136 | vacuum tube |
| 138 | vacuum tube connection |
| 140 | vacuum hose |
| 141 | terminal end of vacuum hose |
| 142 | vacuum wand |
| 143 | eye bolts |
| 144 | cleaning tools |
| 145 | bungee cord |
| 146 | tool connection end |
| 148 | third high pressure hose |
| 150 | first quick connect coupling device |
| 152 | second quick connect coupling device |
| 154 | valve and trigger assembly |
| 156 | grout tool |
| 158 | carpet spray and extractor |
| 160 | grout tool vacuum body |
| 162 | squeegee |
| 164 | vacuum chamber |
| 166 | vacuum inlet |
| 168 | brush |
| 170 | jet bracket |
| 172 | fluid jet |
| 174 | hose |
| 176 | coupling device |
| 178 | blower assembly |
| 180 | blower motor housing |
| 182 | electrical cord |
| 184 | on/off switch |
| 186 | handle |
| 188 | blower nozzle |
| 190 | machine extension wand |
| 191 | A.C. power source |
| 192 | flexible hose |
| 194 | extension wand |
| 196 | vacuum switch |
| 198 | vacuum circuit breaker |
| 200 | pump switch |
| 202 | circuit breaker pump |
| 204 | hour meter |
| 206 | utility bag |
| 208 | hook-on type trash/supply bin |
| 210 | recovery tank clean out and sight port |
| 212 | pull out filling port |
| 214 | first channel of rotary valve |
| 216 | second channel of rotary valve |
| 218 | flat spot |
| 220 | squeegee tool |
| 222 | dry pick up tool |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

While the present invention has been illustrated by description of preferred embodiments and while the illustrative versions have been described in considerable detail, it is not the intention of the inventors to restrict or in any way limit the scope of the appended claims to such detail. Additional advantages and modifications will readily appear to those skilled in the art upon reading this detailed description. Therefore, the invention, in its broader aspects, is not limited to these specific details, respective apparatus and methods, and illustrative examples shown and described. Accordingly, departures may be made from such details without departing from the spirit or scope of the inventors' general inventive concepts.

Figure 1A:
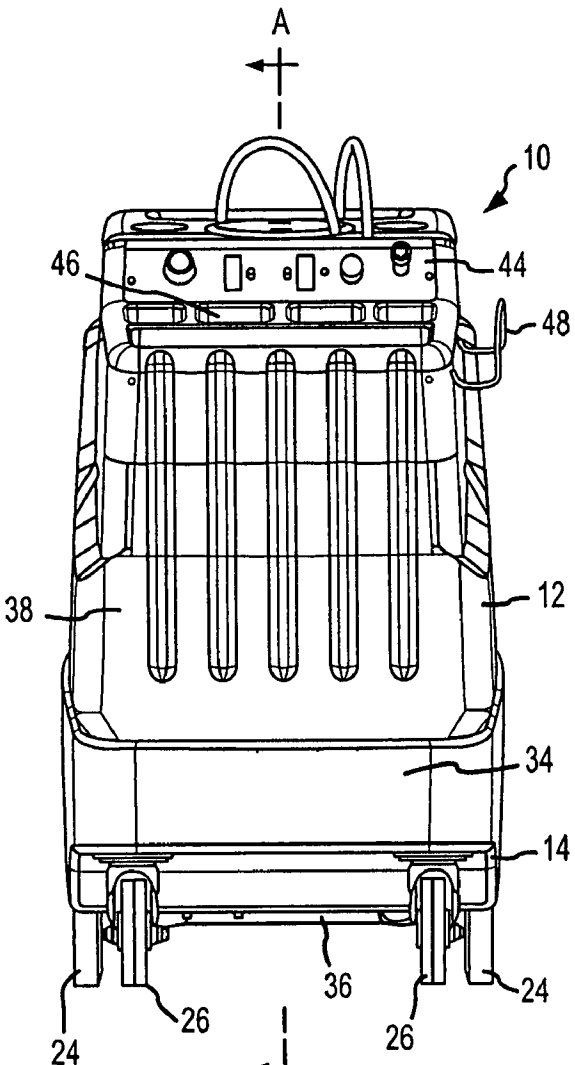
FIG. 1*a* is a front view of one embodiment of a preferred multi-functional cleaning machine.

Referring initially to FIGS. 1*a* and 1*b*, there is shown a multi-functional cleaning machine 10. The machine 10 includes a fluid housing 12 and a base 14. The fluid housing 12 and base 14 are preferably made of plastic, though other suitable materials can be utilized. The fluid housing 12 may be attached to the base 14 in any number of known configurations. The machine 10 has a front 16, a back 18, a top 20 and a bottom 22.

In one embodiment, the base 14 is preferably configured to accept four wheels, two 12-inch, non-pneumatic (although pneumatic could also be used) wheels 24, preferably made by Gleason and offered under Part No. 12479492, located at about the bottom back of the machine 10, and two 6-inch caster wheels 26, preferably made by Colson casters under Part No. 6.00617.441BRK1, located at about the bottom front of the machine 10. The caster wheels 26 are preferably positioned inboard of the drip pan 34, facilitating stability. Such movement can be accomplished by either pulling, or more typically, pushing the machine 10 from the rear by applying pressure to a handle 28 formed in the fluid housing 12, in known fashion. It is preferred that the caster wheels 26 have a built-in brake system which can be set to keep the machine 10 from making unwanted movement.

Figure 2:
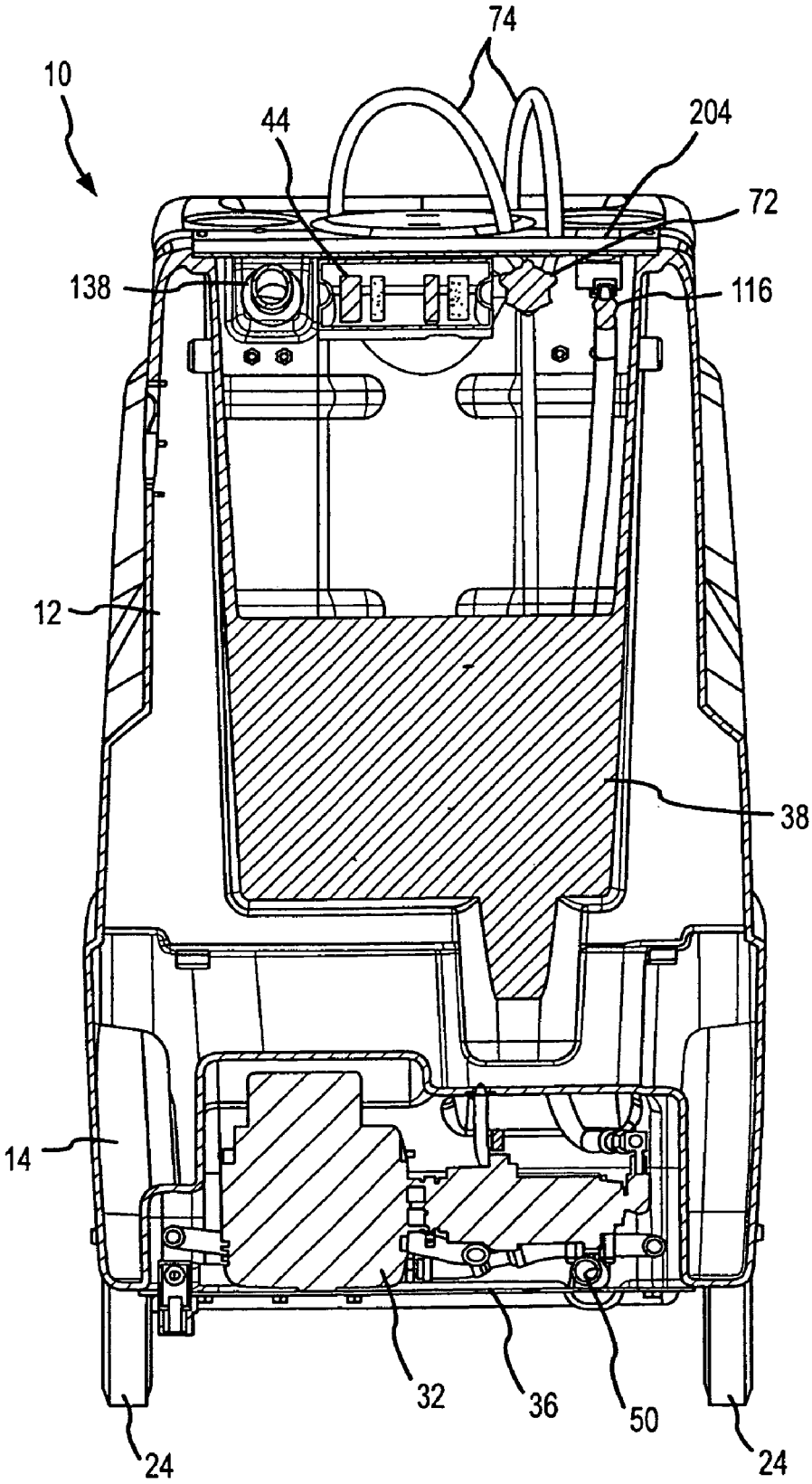
FIG. 2 is a front view of one embodiment of a preferred multi-functional cleaning machine with a cut-away of the machine along line B-B, as shown in FIG. 1*a;*
Figure 3:
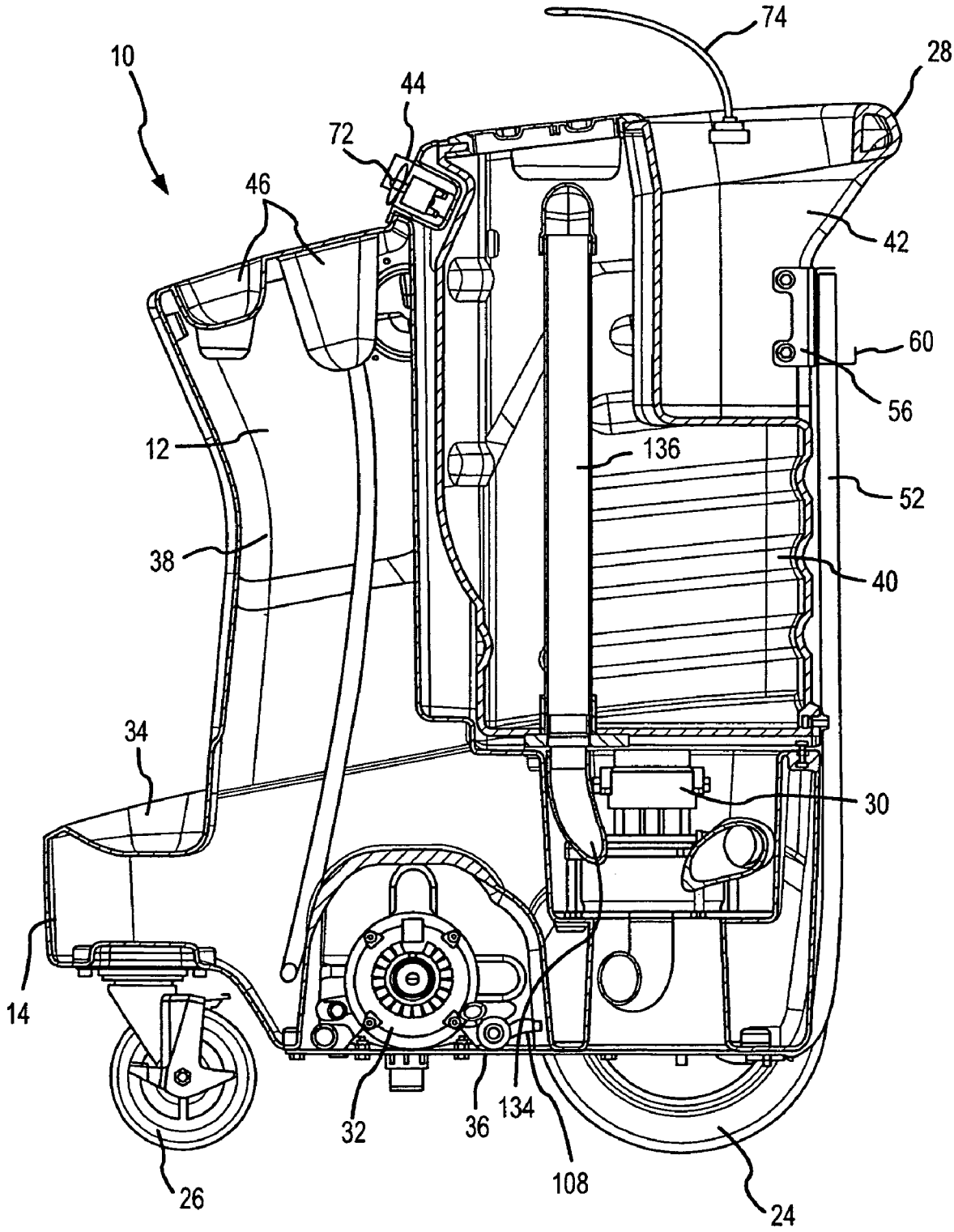
FIG. 3 is a side view of one embodiment of a preferred multi-functional cleaning machine with a cut-away of the machine along line A-A as shown in FIG. 1*b;*
Figure 4A:
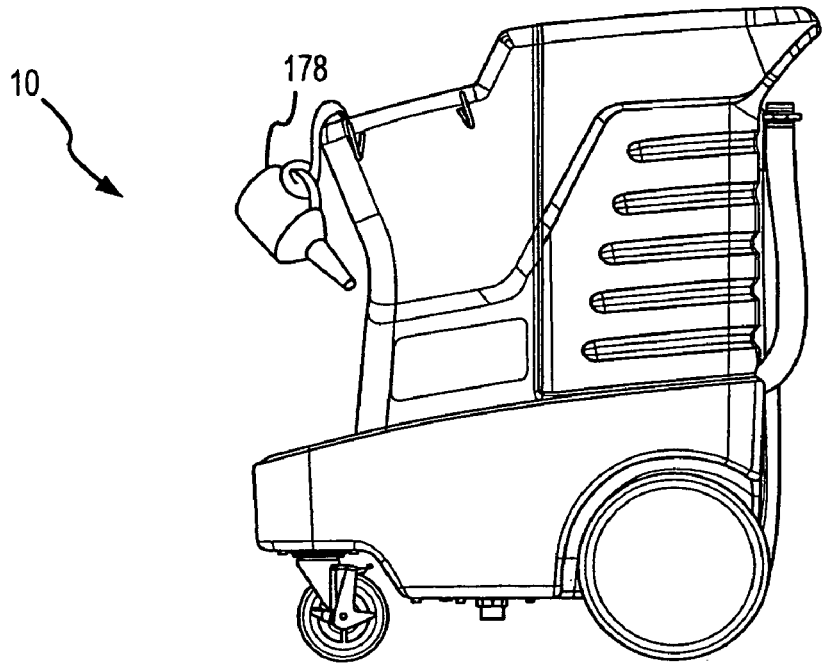
FIG. 4*a* is a side view of one embodiment of a preferred multi-functional cleaning machine showing the blower assembly stored in a preferred position.
Figure 4B:
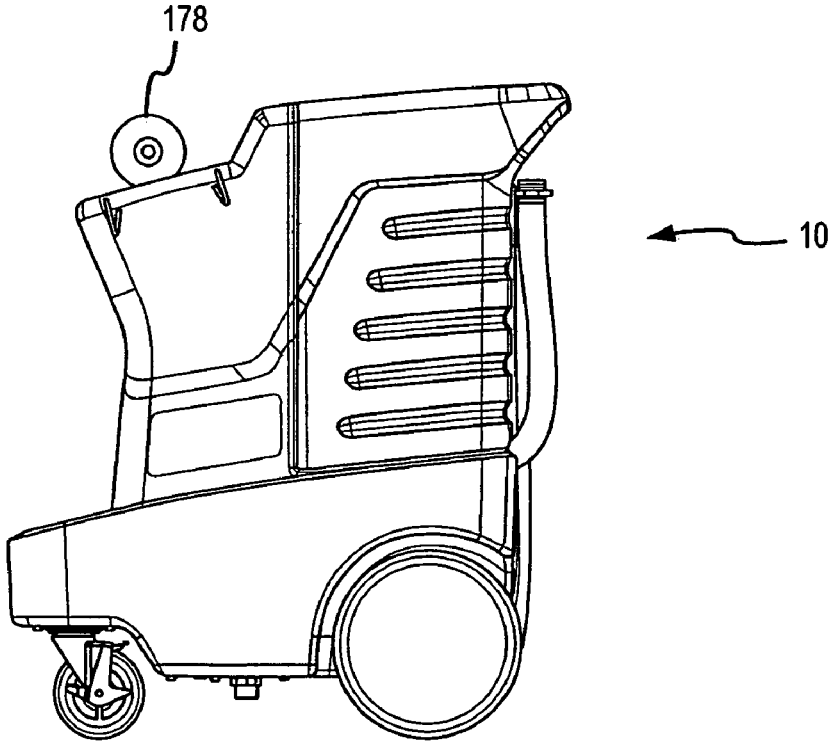
FIG. 4*b* is a side view of one embodiment of a preferred multi-functional cleaning machine showing the blower assembly stored in a preferred position.
Figure 4C:
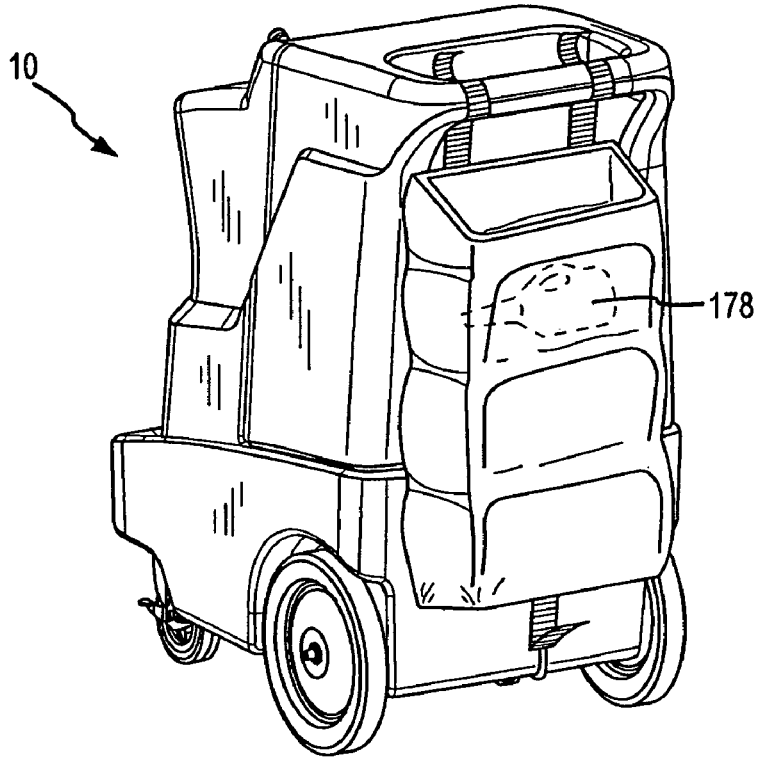
FIG. 4*c* is a perspective view of one embodiment of a preferred multi-functional cleaning machine showing the blower assembly stored in a preferred position.
Figure 4D:
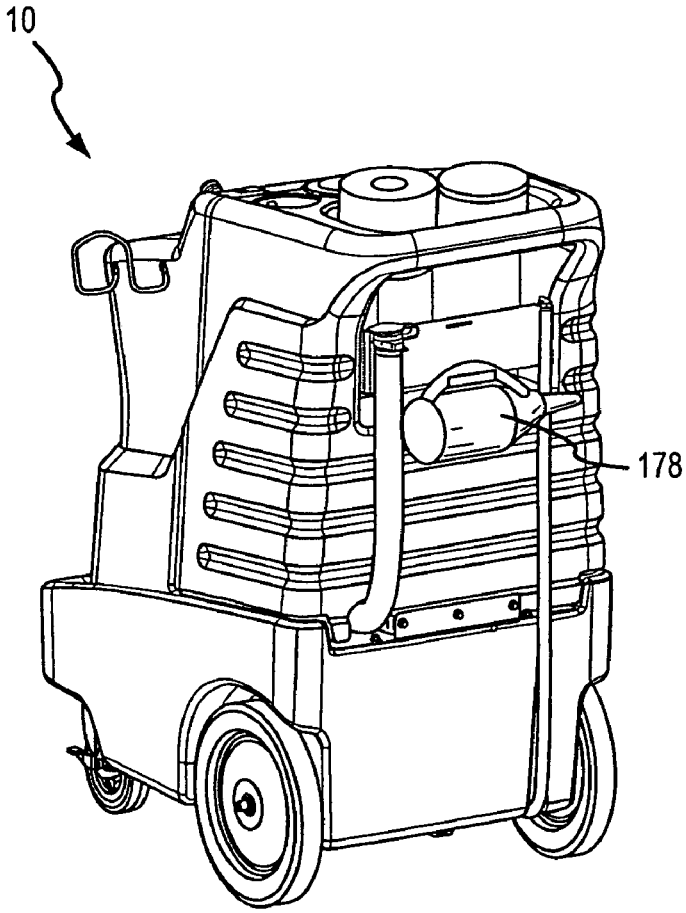
FIG. 4*d* is a perspective view of one embodiment of a preferred multi-functional cleaning machine showing the blower assembly stored in a preferred position.

As can best be viewed in FIGS. 2 and 3, the base 14 is designed to house a vacuum motor 30 and related componentry, a fluid pump 32 and related componentry, and a drip pan 34. The vacuum motor 30 and fluid pump 32 can be mounted directly to the base 14 or to a plate 36, which is then mounted to the base 14. In one embodiment, the vacuum motor 30 is preferably a Lamb Electric motor, Model No. 116392-00. The fluid pump 32 preferably is capable of efficiently drawing to a fluid pump inlet, fluids from tanks, receptacles or the like, through appropriate hoses and associated hardware and plumbing, and then be capable of pressurizing those fluids for subsequent communication to a spray gun or other dispensing device. In one embodiment, the fluid pump 32 is preferably a Model 1LX100.AWI, produced by Emerson. In one embodiment, the drip pan 34 may preferably be formed integral with the base 14 and adapted to create a trough-like structure which is fluid-tight at its base and sides. The drip pan 34 is preferably located at about the front bottom of the machine 10.

As may also be best seen in FIGS. 2 and 3, the fluid housing 12 contains: two tanks—a base fluid (clean) tank 38 and a recovery (dirty) tank 40; a lockable enclosure 42 for secure storage of at least two receptacles; a machine control panel 44; storage bins 46 (best seen in FIG. 1*a*); and a pressure hose retainer 48 (best seen in FIGS. 1*a* and 1*b*). Base fluid tank 38 may retain a base fluid, such as water, and has an inlet adapted to allow the base fluid to enter the tank 38 and an outlet 50 adapted to allow the base fluid to exit the tank 38.

Figure 5:
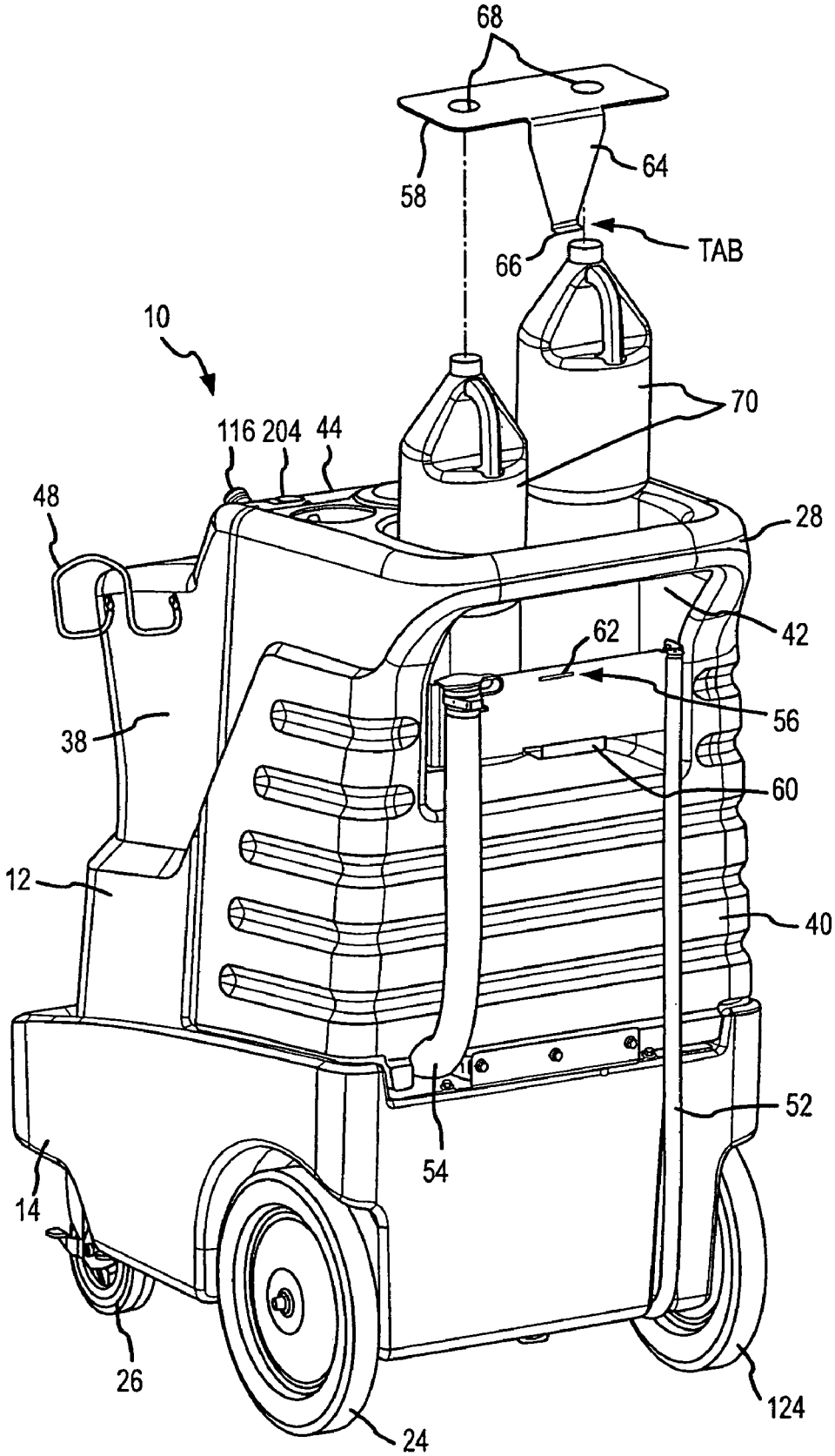
FIG. 5 is a perspective view of one embodiment of a preferred multi-functional cleaning machine.

In one embodiment, the base fluid tank 38 may also have adapted thereto a fluid level indicator 52, best seen in FIG. 5. In the preferred embodiment, the indicator 52 is comprised of a clear tube which is in fluid communication with the tank 38. Fluid level indicator 52 may be attached to the outside of the machine 10. The level of the fluid in the tank 38 is reflected in a known fashion by the level of fluid which will be in the fluid level indicator 52 tube. Those with skill in this art will recognize, however, that various other visual fluid level indicators could be used with the machine 10, including electromechanical indicators. Similarly, audible or sensory indicators could be used to indicate the base fluid level to an operator and are deemed within the scope of inventions disclosed herein. Further, the fluid level indicator 52 can be used, in a preferred embodiment, to allow fluid to drain from tank 38.

The recovery tank 40 is designed to retain a dirty fluid, typically cleaning solution having dirt and debris entrained therein. The recovery tank 40 also has an inlet and an outlet. The inlet is in fluid communication with the vacuum motor 30 and associated assemblies which are designed to deposit dirty fluid into the recovery tank 40. The recovery tank 40 also has a dirty fluid outlet at the recovery tank 40 base and which preferably is in fluid communication with a flexible dump tube 54. The dump tube 54 may preferably be secured to the exterior of the machine 10 and is adapted to allow an operator to dump dirty fluid easily into a work basin, toilet, drain, etc. The dump tube 54 also can be made of a clear material and, similar to the base fluid level indicator 52, can be used to indicate the level of dirty fluid within the recovery tank 40.

As can be best seen in FIGS. 3 and 5, in one embodiment, the lockable enclosure 42 is essentially comprised of a lockable box. In one embodiment, the box base and three of the box walls are preferably formed using walls of the fluid housing 12. A retaining plate 56 and a cover plate 58 are preferably used to create the fourth wall and box cover, respectively. Retaining plate 56 may be secured in known fashion to at least two of the there-existing walls of the enclosure (see FIG. 3). In one embodiment, retaining plate 56 also preferably includes a hook 60 (other hooks could also preferably be provided) to facilitate hose or storage of other devices, including "wet floor" signs, and a slot 62 capable of accepting a tab or similar device. In one embodiment, the cover plate 58 preferably is adapted to securely fit over the top of the box, forming the lockable enclosure 42. In one embodiment, the cover plate 58 includes a projection 64 terminating in an out-turned tab 66, having an opening (i.e., aperture) formed therein. The cover plate 58 may also include apertures 68 to facilitate fluid communication between a selector and metering valve 72 and chemical receptacles 70, which may be placed within the lockable enclosure 42. In use, the projection tab 66 of the cover plate 58 is adapted to pass at least partially through the retaining plate slot 62. As will be appreciated by those skilled in the art, once that occurs, a lock or similar device can be secured to or through the projection tab 66 aperture, locking the cover plate to the lockable enclosure 42. Obviously, the lockable enclosure 42 could be created in any number of ways which are deemed within the skill of persons working in this art area. Moreover, those skilled in the art would understand that the lockable enclosure 42 could be created as a separable or separate enclosure, not formed integral with the fluid housing 12.

Figure 6:
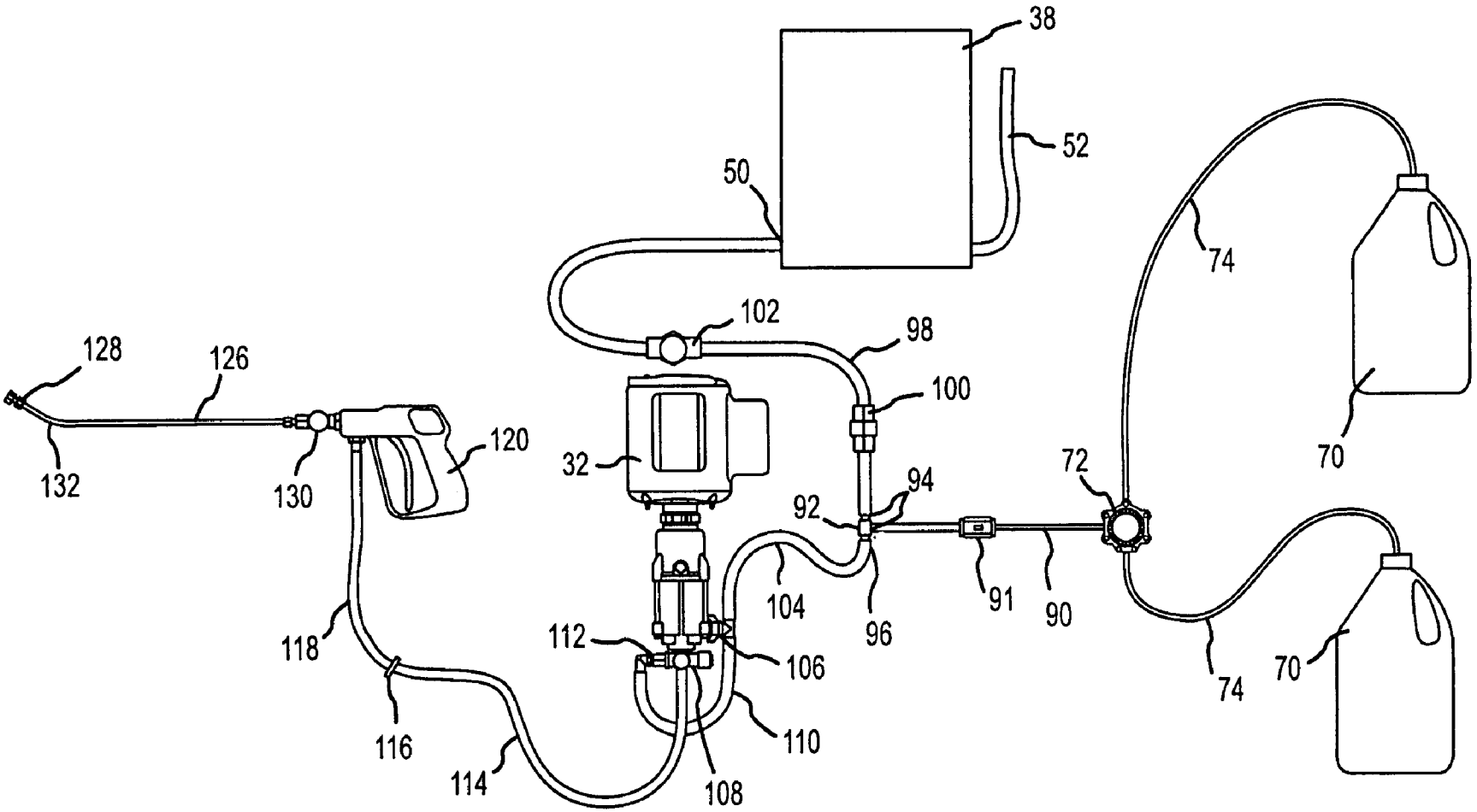
FIG. 6 diagrams one embodiment of a cleaning solution creation and delivery system of a preferred multi-functional cleaning machine.

Fluid storage receptacles 70 are best seen in FIGS. 5 and 6. The receptacles 70 are preferably adapted to contain concentrated cleaning and like chemicals. The receptacles 70 may be configured in virtually any shape and be made of virtually any material capable of safely containing fluids to be stored therein, including metal, glass or plastic. The receptacle 70 may also include handles for ease of movement and replacement, and a resealable cap to secure fluid stored therein.

As best seen in FIGS. 1*a*, 1*b*, 2 and 3, machine control panel 44 houses switches, hose connection ports, and circuit breakers, etc., all needed to operate various aspects of the machine 10. The control panel 44 is preferably located near the top of the fluid housing 12 and positioned in such a way as to face the machine 10 front. In this way, control panel 44 is easily reachable by a user when that operator is using the machine 10 to conduct cleaning operations. Storage bins 46 are preferably adjacent the control panel 44 to further facilitate ease of machine 10 use and to provide a traditional work station working environment, though in this case, portable. Finally, the pressure hose retainer 48 may be secured to the outside of the fluid housing 12. The retainer 48 is preferably adapted to easily retain a pressure hose, the use of which is explained below.

In one embodiment, the multi-functional cleaning machine 10 is adapted to create, on board, one of several different cleaning solutions. Such cleaning solutions may be created by mixing a base fluid, such as water, with a predetermined amount of one or more cleaning chemicals. Such a cleaning solution is generally created by a solution fluid system, a preferred embodiment of which will now be described.

As is set forth in FIG. 6, the fluid system includes at least two chemical receptacles 70, in secure fluid communication, via suitable tubing 74, with the chemical selector and metering valve 72. As is known, one end of tubing 74 may be positioned through a cap or other closing structure applied to the chemical receptacles 70, the tubing 74 being placed into the chemical receptacle 70 for supplying fluid stored therein to an inlet of the chemical selector and metering valve 72, which shall now be explained.

Figure 7A:
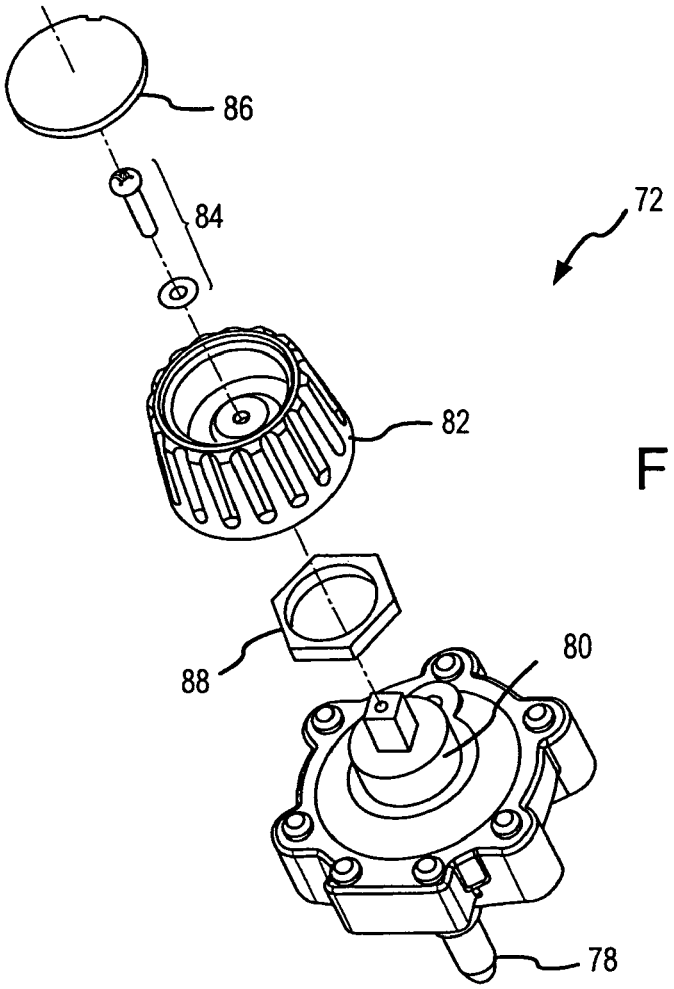
FIG. 7*a* is an exploded view of one embodiment of the selector and metering valve of a preferred multi-functional cleaning machine.
Figure 7C:
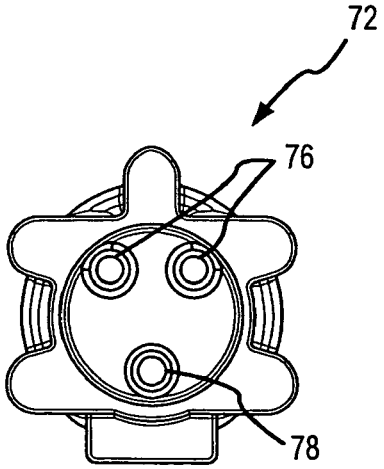
FIG. 7*c* is a rear view of one embodiment of the selector and metering valve of a preferred multi-functional cleaning machine.
Figure 7B:
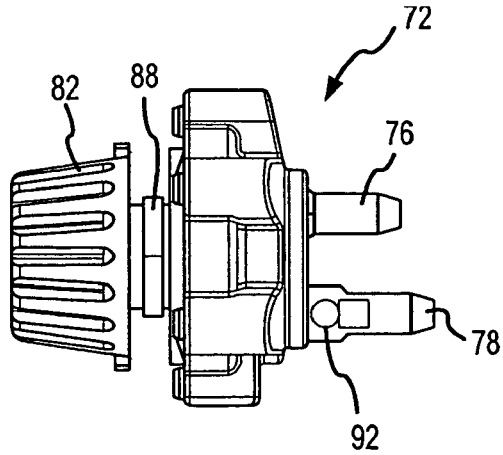
FIG. 7*b* is a side view of one embodiment of the selector and metering valve of a preferred multi-functional cleaning machine.

As shown in FIGS. 7*a*, 7*b* and 7*c*, in one embodiment, the chemical selector and metering valve 72 may preferably be a mechanical device having at least two fluid inlets 76 and one fluid outlet 78, which may preferably also include a one-way check valve. In one embodiment, the preferred selector and metering valve 72 is Model No. ST-66, manufactured by Suttner.

In one embodiment, the selector and metering valve 72 includes a rotary valve 80, to which is attached a knob 82. The knob 82 is interconnected to the rotary valve 80 by a screw and washer 84. Optionally, a cap 86 may be used to protect the screw and washer 84 and knob 82. The selector and metering valve 72 may preferably be secured to the control panel 44 via a retaining nut 88, in known fashion.

Figure 7D:
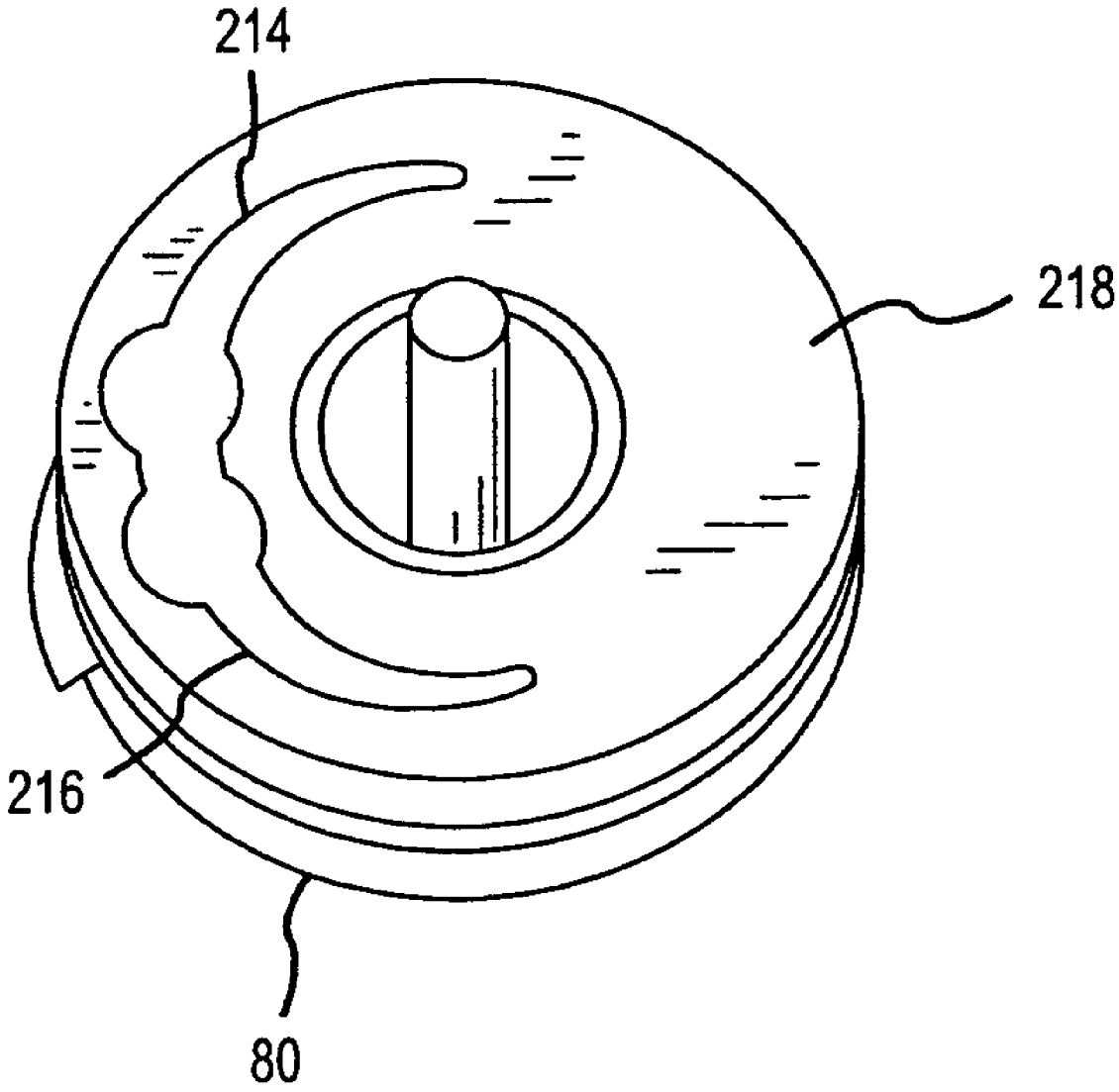
FIG. 7*d* is a perspective view of one embodiment of the valve of the selector and metering valve.
Figure 8A:
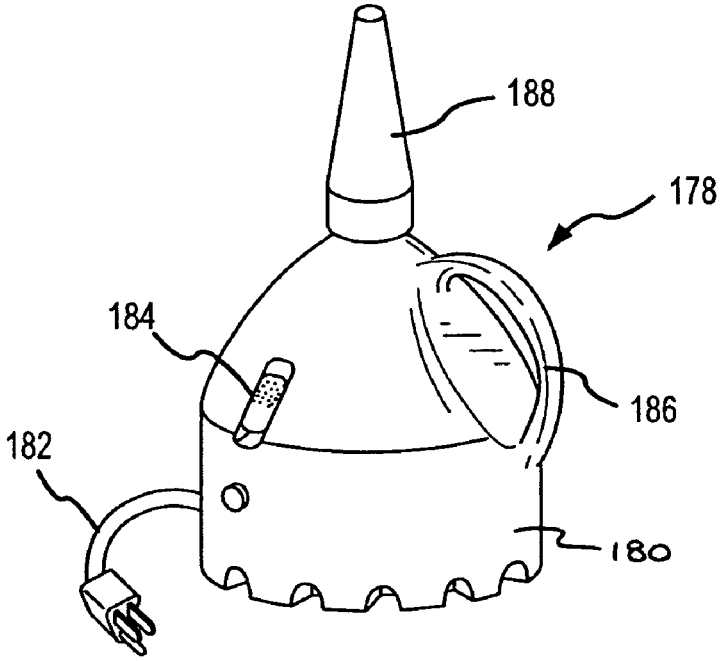
FIG. 8*a* is a front view of one embodiment of the modular blower assembly of a preferred multi-functional cleaning machine.
Figure 8B:
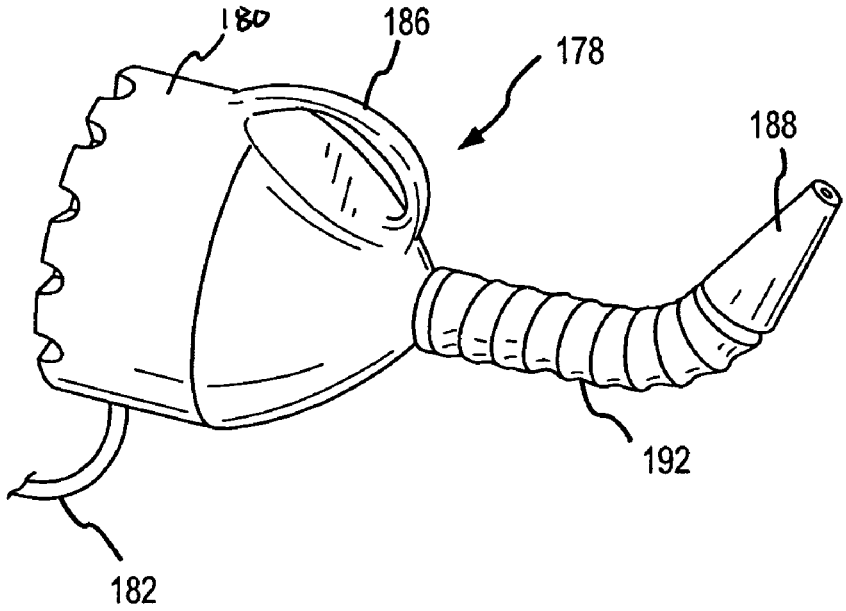
FIG. 8*b* is a perspective view of one embodiment of the modular blower assembly utilizing a flexible nozzle extension.
Figure 8C:
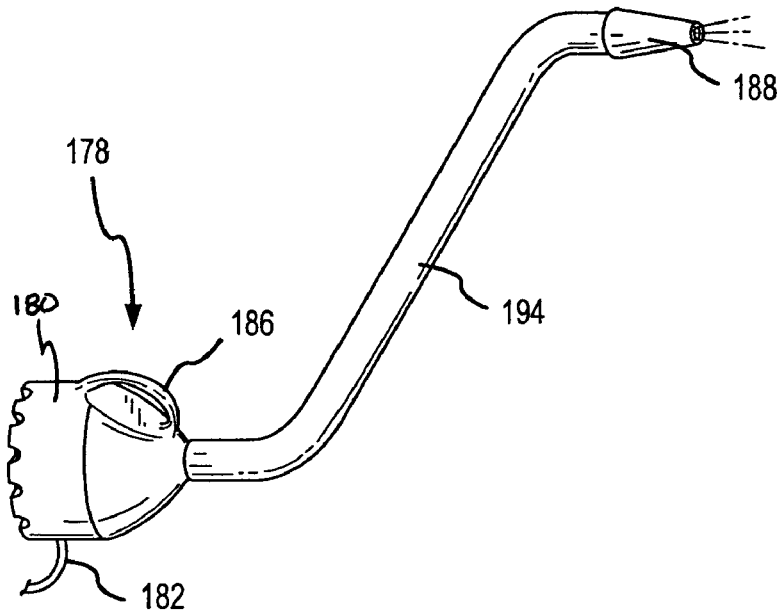
FIG. 8*c* is a perspective view of one embodiment of the modular blower assembly utilizing an extension wand between the blower body and nozzle.
Figure 8D:
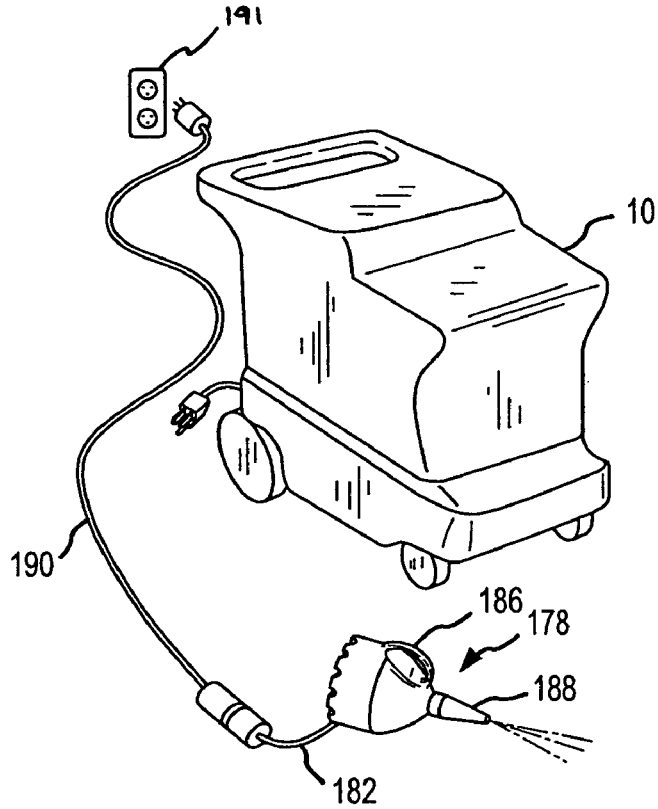
FIG. 8*d* depicts use of one embodiment of the modular blower assembly of a preferred multi-functional cleaning machine.

As can be seen in FIG. 7*d*, in one embodiment, the rotary valve 80 has two channels 214, 216 and a flat spot 218. When an internal fluid communication from the selector fluid outlet 78 rests against the flat spot 218, no fluid is allowed to flow through outlet 78. As an internal communication port is moved to the channel 214 or 216 by rotation of the knob 82, fluid from the receptacle 70 will begin to be allowed to flow to outlet 78. If the knob 82 continues to be rotated, the internal communication port is moved along the channel, 214 or 216, which is increasing in size. The size of the channel 214 or 216 will dictate how much fluid is allowed to pass to outlet 78.

As will be understood by those of skill in the art, the operator may rotate the knob 82 to allow fluid to flow through one or the other of the selector fluid inlets 76. The operator could regulate the amount of fluid allowed to flow therethrough by regulating the total amount of knob 82 rotation, in known fashion. It should be understood by those with skill in the art that additional inlets and outlets can be added to the selector and metering valve 72. Additionally, skilled artisans will readily understand that selection and metering of a chemical can easily be accomplished by separate mechanical, as well as electromechanical devices. The selection and use of such alternative selectors and/or metering valves are deemed well within the ordinary skill in the art and are to be considered encompassed by this disclosure. It should also be understood that a selector and metering valve 72 can be configured to allow more than one chemical to flow through the valve 72.

With reference again to FIG. 6, in operation and depending upon operator positioning of a knob for control of the selector and metering valve 72, a fluid, such as a concentrated cleaning chemical, can flow through the selector and metering valve 72 to the selector fluid outlet. Coupled thereto in secure fluid communication is suitable tubing 90. In line with tubing 90 may be a chemical check valve 91 or a filter (not shown). It should be understood that a check valve or filter could, if desired, also be disposed in line with the receptacle to selector tubing 74. The second end of tubing 90 is preferably in secure fluid communication with a mixing tee 92.

In one embodiment, the mixing tee 92 preferably has two inlets 94 and one outlet 96. One inlet 94 is in secure fluid communication with tubing 90. The second mixing tee inlet 94 is in secure fluid communication with a base fluid tube 98. The other end of the base fluid tube 98 is in secure fluid communication with the base fluid tank outlet 50. A solution check valve 100 and/or filter 102 may preferably be placed in line with base fluid tubing 98. A solution check valve 100 may also be included as part of the mixing tee 92.

Fluids which flow from tubes 90, 98 to inlets 94 may be at least partially mixed within the mixing tee 92, exiting outlet 96 as a cleaning solution. Those skilled in the art will understand that the mixing tee 92 may take many shapes, sizes and configurations. For instance, the mixing tee 92 could have multiple inputs and multiple outlets. The mixing tee 92 could also include a mixing chamber into which fluids are dumped and perhaps agitated, prior to exiting the outlet 96. Also, the mixing of fluids could be achieved by use of a forceful mixing structure, such as an injection structure, instead of the preferred passive structure disclosed herein.

Figure 9A:
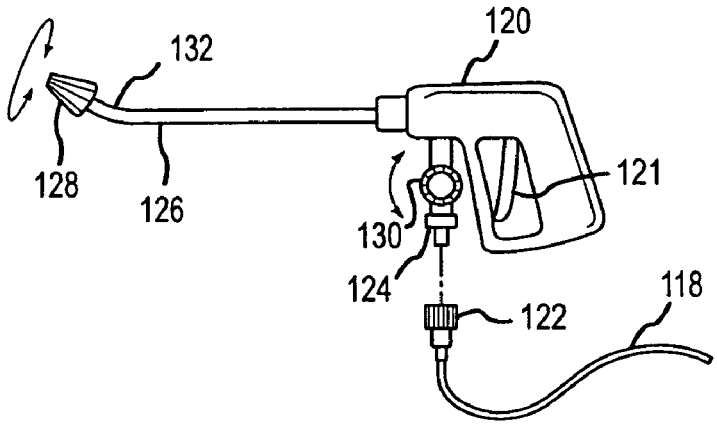
FIG. 9*a* is a front view of one embodiment of the spray gun and high pressure hose of a preferred multi-functional cleaning machine.

Mixed fluid, referred to generally as a cleaning solution, is preferably then passed by tube 104 to fluid pump 32, tube 104 being in secure fluid communication at one end with the mixing tee outlet 96, and at the other end to a fluid inlet 106 of fluid pump 32. Pump 32 can preferably pressurize cleaning solution supplied to inlet 106 and pass that pressurized cleaning solution to pump outlet 108. Pump 32 will pressurize cleaning fluid at a preferred constant pressure of 50 to 460 pounds per square inch. The pump 32 will also create a suction in tube 104, generally facilitating pulling of base fluid from tank 38 and, if selected, one or more chemical receptacles 70. The pump 32 may also preferably be equipped with a bypass line 110 and bypass valve 112, which are useful in regulating the fluid line pressures. If so equipped, cleaning solution can either be pressurized by the pump 32 or fed in an unpressurized fashion to any number of cleaning tools by providing the cleaning solution through bypass line 110 and valve 112 to such tools. In secure fluid communication with pump outlet 108 is a high pressure hose 114 of suitable construction. Preferably, high pressure hose 114 is plumbed to the control panel 44, where it connects in a secure fluid communication with a high pressure hose quick connect coupling device 116. As is known in the art, a second high pressure hose 118, shown in FIG. 9*a*, may preferably connect, at one end, to coupling 116 (not shown in FIG. 9*a*), and in like fashion, may be coupled via a female quick connect 122 to a spray gun 120 male quick connect coupling device 124. Obviously, the male and female connectors could be reversed. Operation of a high pressure spray gun 120 will not generally be discussed herein, as it is deemed well known in the art. However, it needs to be understood that depression of the spray gun 120 trigger 121 generally allows pressurized fluid to exit the spray gun 120, often through a valve 130, lance wand 126 and spray jet 128. A preferred spray gun 120 is manufactured by Suttner, under Part No. ST810.

Typically, an operator of the spray gun 120 cannot accurately control the pressure and flow with which cleaning solution is allowed to exit the spray gun 120. Instead, the spray gun 120 usually operates in a binary, i.e., high/low or on-off, fashion. As such, only fluid at selected line pressures is allowed to exit the spray gun 120. Such operation is often problematic for a cleaning operator, as it may be necessary to use a pressure and fluid flow different from a present pressure and flow for a given cleaning operation. Accordingly, it is preferable to include the variable pressure reduction valve 130 somewhere in line with the pressurized cleaning solution. In one embodiment, a preferable valve 130 is a needle valve adapted for use to provide maximum adjustment in preferably one turn. Such a valve is manufactured by Generant of New Jersey under Part No. FFP-882 and is preferably adapted to selectively reduce the pressure and flow capacity, simultaneously, of pressurized cleaning solution which is allowed to exit the spray gun 120. In one embodiment, it is preferable to have the variable pressure reduction valve 130 located near or on the spray gun 120, itself, for ease of use of the valve 130 by an operator when that operator is engaged in cleaning a surface. The reduction valve 130 may be capable of reducing line pressure to zero, at one extreme of the operating spectrum, and provide no reduction in line pressure at the other extreme of the operating spectrum, and be infinitely adjustable between those spectrum ends. Preferably, however, the valve 130 should not completely shut-off line pressure and flow. Instead, that should be accomplished by release of the spray gun 120 trigger 121.

Figure 9B:
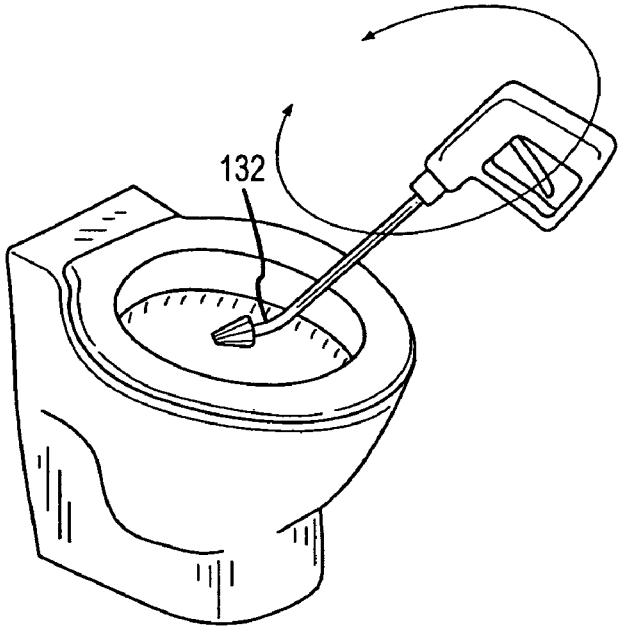
FIG. 9*b* depicts use of one embodiment of a spray gun in cleaning of a typical toilet.
Figure 9C:
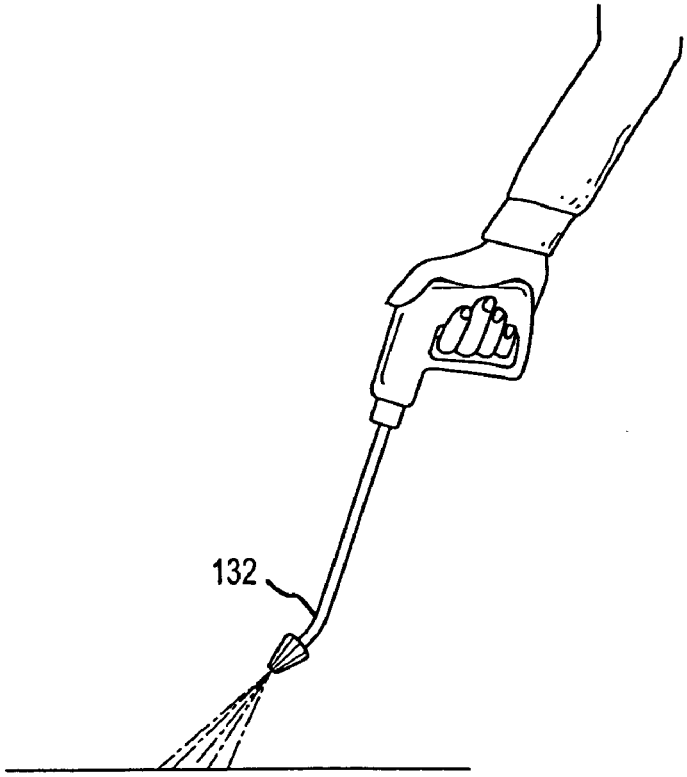
FIG. 9*c* depicts use of one embodiment of a spray gun in cleaning a typical horizontal surface, such as a floor.

It is also preferable to use a curved lance wand 126 with the spray gun 120. Such a wand 126, as shown in FIGS. 6 and 9*b* and 9*c*, facilitate cleaning of toilets (see FIG. 9*b*) and horizontal cleaning surfaces (see FIG. 9*c*). Indeed, curvature 132 of lance wand 126, with the curvature 132 being achieved at or near the terminal end of the wand 126, provides ergonomic enhancements to a user of the device not available with a straight lance wand. Specifically, the wand 126 angle works in combination with the angle of a handle of the gun 120 to position a user's wrist in a neutral grip position (see FIG. 9*c*). Also the wand 126 angle promotes safety. Due to the wand 126 angle, the operator can maintain maximum distance from cleaning chemicals exiting the gun 120, not having to bend into hard to reach surfaces needing cleaning. Finally, it is preferable to have an adjustable spray jet 128 (variable to adjust a spray pattern) attached to a wand 126 end to facilitate fluid spray patterns and the like. A fixed spray jet 128 could also be used.

In operation, the fluid system may create and dispense, under pressure, a cleaning solution to a surface to be cleaned. The pressurized cleaning solution alone, or with help of a brush or other cleaning device, may be used to clean the surface. Once cleaned, however, the dirty solution must preferably be removed from the surface. This can be accomplished by vacuuming the fluid into a storage tank or drying the fluid from the surface in some other fashion, or a combination thereof. A vacuuming function may be performed, in known fashion, through use of a wet vacuum and related assemblies.

Figure 10A:
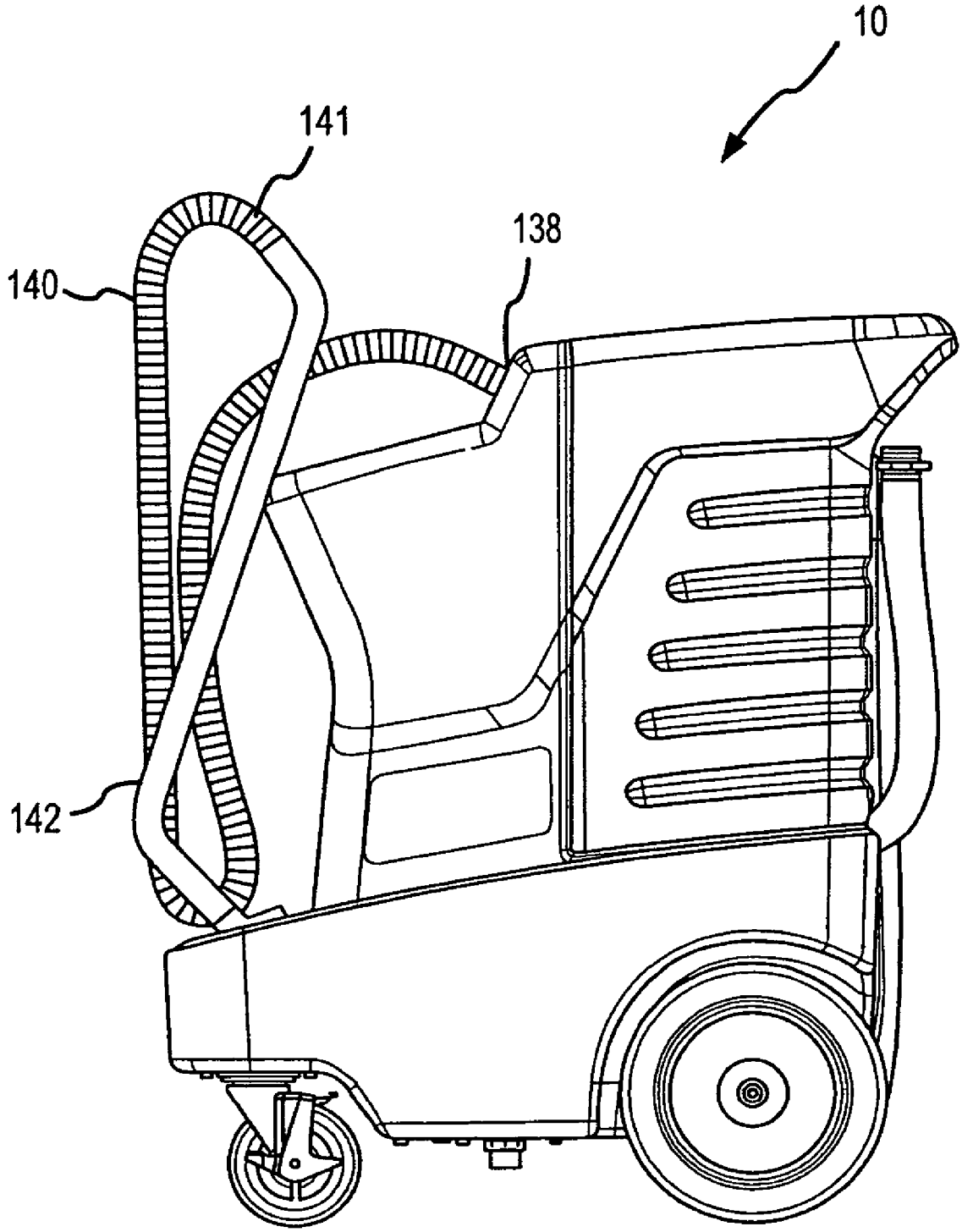
FIG. 10*a* is a side view of one embodiment of a preferred multi-functional cleaning machine with a self-retracting vacuum hose connected to a modular wand, at one end, and a control panel at the other end, with a tool attached to the wand and stored in a drip pan.
Figure 10B:
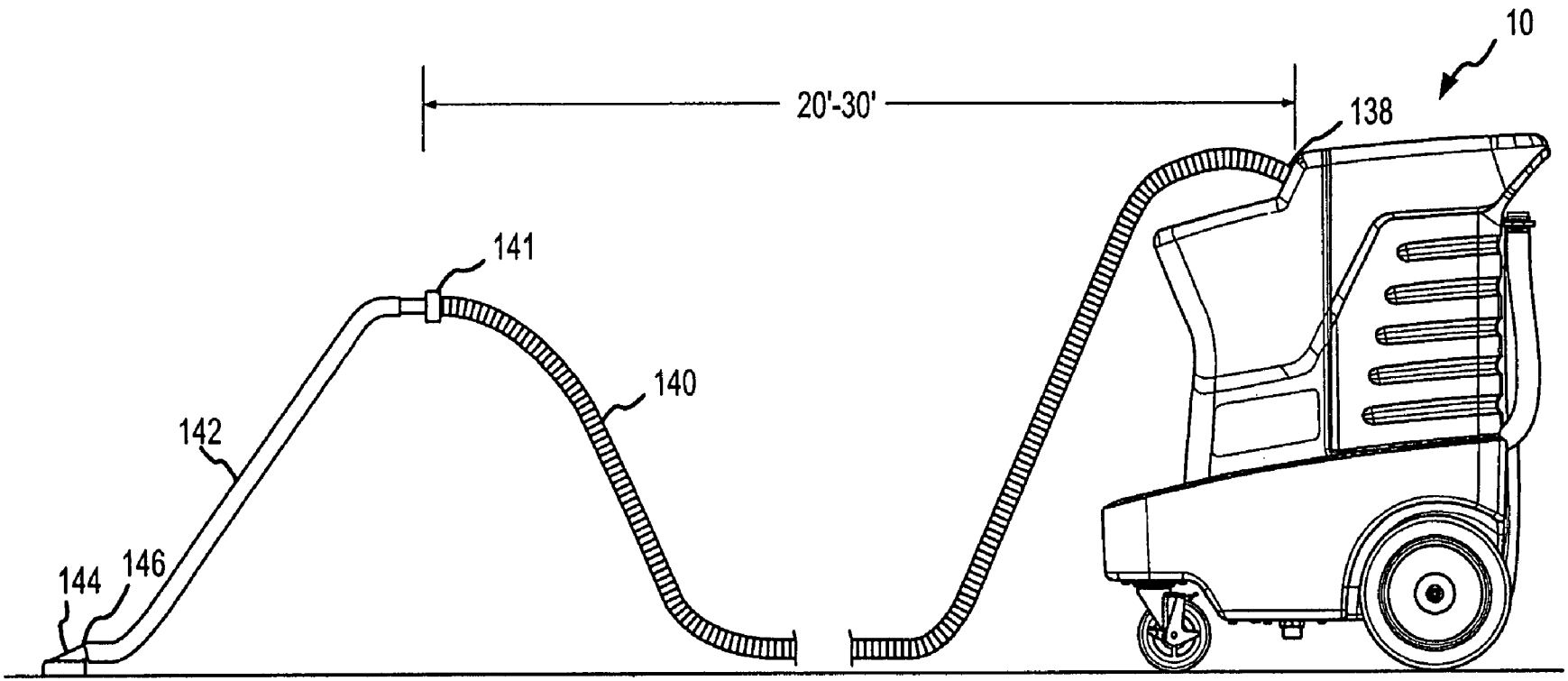
FIG. 10*b* is a side view of one embodiment of a preferred multi-functional cleaning machine with a self-retracting vacuum hose extended for use and connected to a modular wand and tool.

In the preferred embodiment, as seen in FIG. 3, vacuum motor 30 has an inlet 134 which is in fluid communication with a vacuum tube 136. The other end of the vacuum tube 136 is in secure fluid communication with vacuum tube connection 138, located on the control panel 44. (See FIG. 17.) Turning now to FIGS. 10*a* and 10*b*, typically a vacuum hose 140 is adapted for sealable connection to the vacuum tube connection 138. Preferably, the vacuum hose is self-retracting and need not be wound for storage. Instead, the vacuum hose 140 may compress to a convenient size for easy storage on the machine 10. When in use, however, the vacuum hose 140 can expand to facilitate cleaning operations at distances of, in one embodiment, at least 25 feet from the machine 10. In one embodiment, such a vacuum hose 140 is manufactured by United Electric and offered under Part No. 15ST5BK.1.

Figure 11:
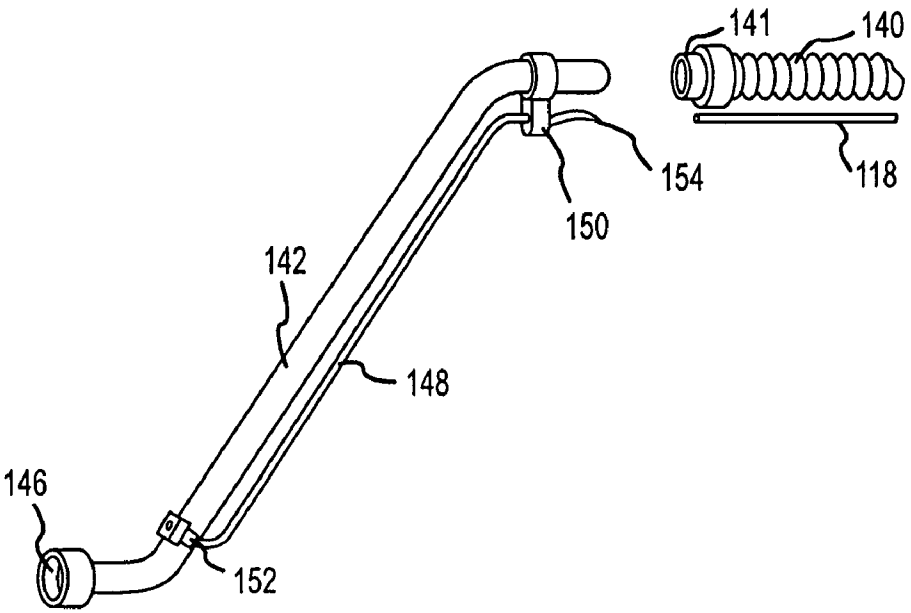
FIG. 11 is a perspective view of one embodiment of a modular wand of a preferred multi-functional cleaning machine.
Figure 15:
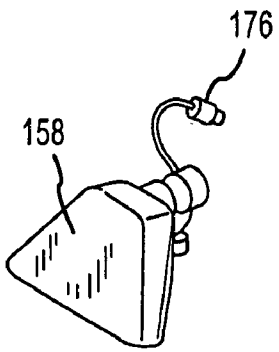
FIG. 15 is a perspective view of one embodiment of a carpet spray and extractor for use with a modular extension wand.
Figure 14A:
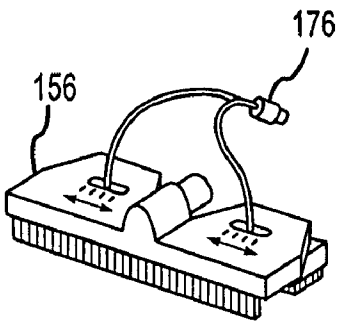
FIG. 14*a* is a perspective view of one embodiment of a grout tool for use with a modular extension wand.
Figure 13:
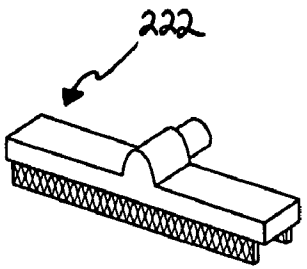
FIG. 13 is a perspective view of one embodiment of a dry pick-up tool for use with a modular wand.
Figure 12:
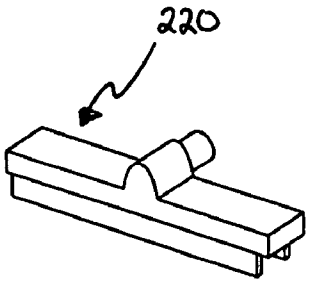
FIG. 12 is a perspective view of one embodiment of a squeegee for use with a modular wand.

Attached to the terminal end 141 of vacuum hose 140 is preferably a vacuum wand 142, to which cleaning tools 144 may be attached, as shown in FIGS. 10*a*, 10*b* and 11. With reference to FIG. 11, in a preferred embodiment, the vacuum wand 142 is of a modular design, facilitating easy use of both dry and wet tools with the wand 142. The preferred vacuum wand 142 has an end 146 adapted to accept a vacuum tool, such as a squeegee tool 220 (see FIG. 12), a dry pick up tool 222 (see FIG. 13), a grout tool 156 (see FIG. 14*a*), or a carpet spray and extractor 158 (see FIG. 15). The vacuum wand 142 is also adapted to carry a third high pressure hose 148, having a first quick connect 150 and a second quick connect 152 coupling device.

In one embodiment, the first quick connect coupling device 150 is adapted to easily attach to the second high pressure hose 118. A valve and trigger assembly 154 is preferably located adjacent the first quick connect 150 and is adapted to control the flow of fluid from the second high pressure hose 118, which is to be passed to the third high pressure hose 148. The second quick connect coupling device 152 is adapted to facilitate quick and easy attachment of fluid hoses which may be associated with individual cleaning tools, such as the grout tool 156 or carpet spray and extractor 158. For instance, on the grout tool 156, two fluid lines are attached, in known fashion, to a single quick connect coupling device 176 at one end, and to two spray jets at their other ends (see FIG. 14*a*). The quick connect coupling device 176 of the grout tool 156, may easily be connected to the second quick connect coupling device 152 of third high pressure hose 148, in known fashion.

Figure 14B:
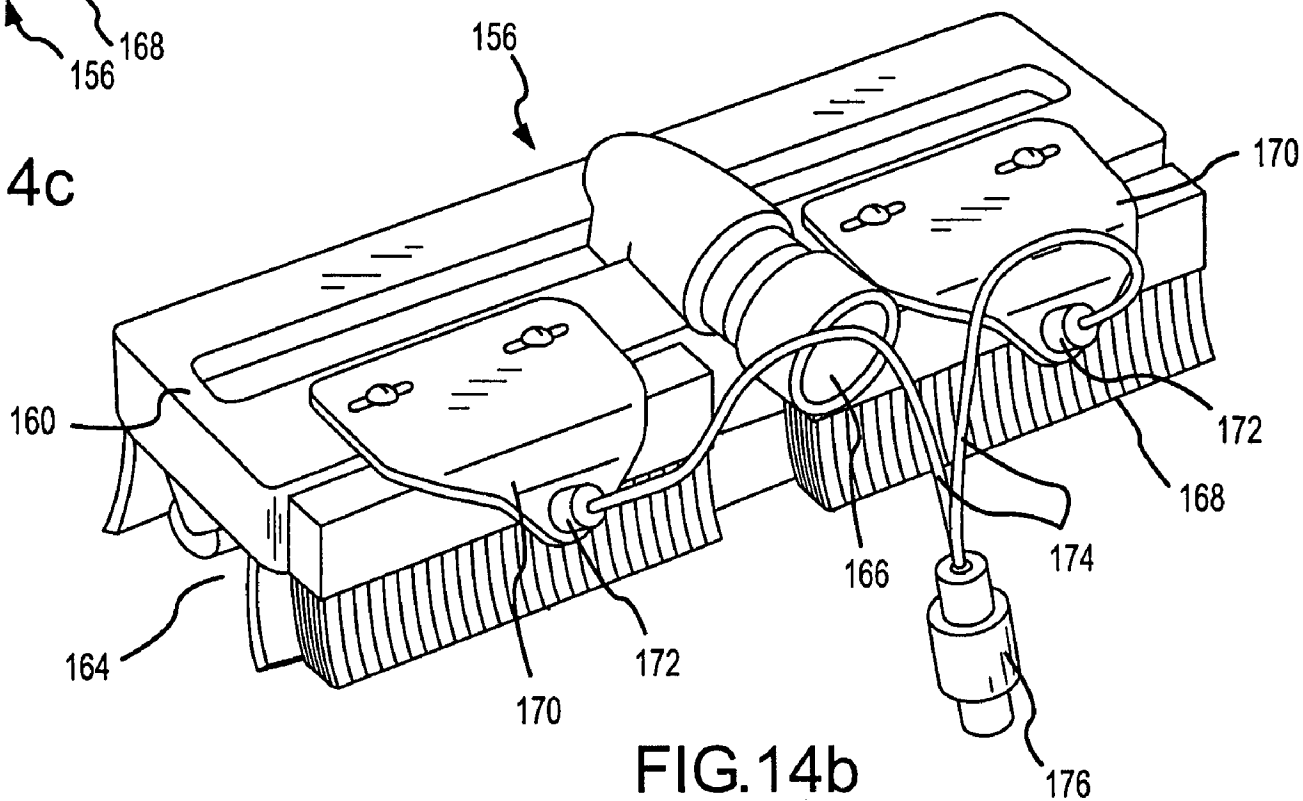
FIG. 14*b* is a second perspective view of one embodiment of a grout tool for use with a modular extension wand.
Figure 14C:
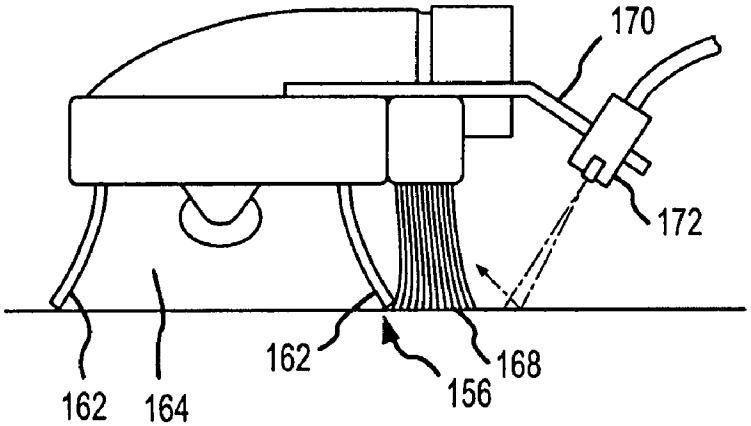
FIG. 14*c* is a side view of one embodiment of a grout tool for use with a modular extension wand.

Now with reference to FIGS. 14*b* and 14*c*, one embodiment of the preferred grout tool 156 is disclosed. The grout tool 156 consists of an elongated vacuum body 160, with two squeegees 162 formed therein and adapted for contact with a surface. A vacuum may be applied to a vacuum chamber 164 through vacuum inlet 166, in known fashion. Attached to the tool body and adapted to contact a surface is also a brush 168, which may be used to scrub a surface being cleaned. Attached in adjustable fashion to a top surface of the tool 156 are two jet brackets 170. Attached to each bracket 170 is a fluid jet 172, each of which is connected to a hose 174, with both hoses terminating and being in secure fluid communication with a single quick disconnect coupling device 176. It has been found that placing the jets 172 on the body of the tool 156, as opposed to on the cleaning wand itself, facilitates cleaning operations, as the jets are moved closer to the surface to be cleaned than has previously been allowed. Also, jet 172 pressures, capacities, capabilities and spray patterns may be matched to the unique tool 156 applications. Further, angling of the jets 172 relative to the tool body 160, as can be seen in FIG. 14*c*, allows pressurized fluid to hit a surface at an angle, further facilitating cleaning. Moreover, due to the angling of the jets 172, fluid may bounce off the surface being cleaned at an angle and into the brush, thereby lubricating the brush with cleaning solution, further facilitating cleaning of the surface, and reducing spray back atomization which is a potential health risk to the operator.

Once a surface has been cleaned and excess dirty cleaning solution removed from the surface via a vacuum or removal process, it is often desirable to blow dry the surface. A blower can also be useful in other cleaning activities, such as blowing dust from upholstery and like objects, or blowing leaves and like debris from a particular surface. The present invention utilizes such a blower, which is uniquely modular in design and functionality.

Now with reference to FIGS. 8*a*, 8*b*, 8*c* and 8*d*, one embodiment of the preferred modular blower assembly 178 of the present invention is disclosed. The blower assembly 178 includes a blower motor (not shown) housed within a housing 180. In one embodiment, the motor (not shown) is preferably a motor produced by Lamb Electric, a division of Amatek, and offered under Part No. 116309-00. Energy may be supplied to the blower motor assembly 178 through an electrical cord 182. In one embodiment, the blower assembly 178 also includes an on/off switch 184 (see FIG. 8*a*). The blower assembly 178 may further include a handle 186 and may have a blower nozzle 188, through which air may be blown.

In one embodiment, the blower assembly 178 may be supplied electrical energy from the same electrical cord 190 that is generally used to supply A.C. power 191 to the machine 10. Alternatively, if the machine 10 runs on battery power, that same battery power could be supplied to the blower assembly 178 in a known fashion. In one embodiment, the blower assembly 178 can also include a flexible hose 192 or extension wand 194 disposed between the blower motor and the nozzle 188 to extend the reach and functionality of the blower assembly 178 (see FIG. 8*c*). The blower assembly 178 may preferably be stored on the machine 10, as shown in FIGS. 4*a*, 4*b*, 4*c*, and 4*d*.

Figure 16:
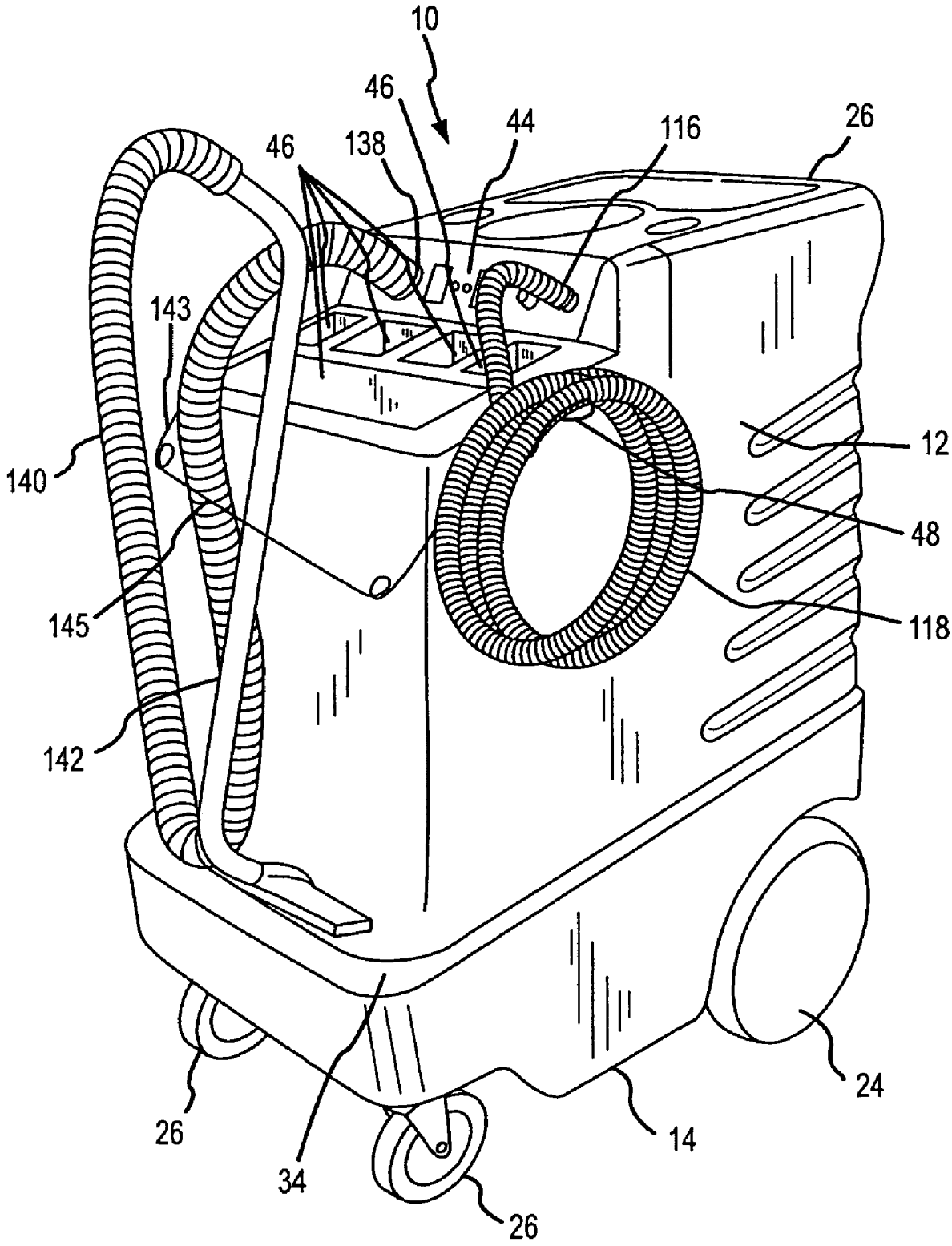
FIG. 16 is a perspective view of one embodiment of a preferred multi-functional cleaning machine showing preferred placement of a vacuum hose and cleaning solution pressure hose.

Now with reference to FIG. 16, one embodiment of the machine 10 is set forth, showing placement of the second high pressure hose 118 wrapped around pressure hose retainer 48 and with second high pressure hose 118 being plugged into hose connection 116. FIG. 16 also shows placement of one embodiment of the control panel 44 and storage bins 46 in a work station configuration. FIG. 16 also shows vacuum hose 140, in a compressed fashion, connected at one end to vacuum tube connector 138 of control panel 44 and at the other end to extension wand 142. For storage, in one embodiment, eyebolts 143 and a cord, such as a bungee cord 145, can be used to secure the hose 140 to the machine 10. Additional means of securing the hose 140 to the machine 10 are also envisioned and within the scope of the present invention. It should be noted that a vacuum tool is shown attached to the terminal end of the extension wand 190, which is positioned over the drip pan 34.

Figure 17:
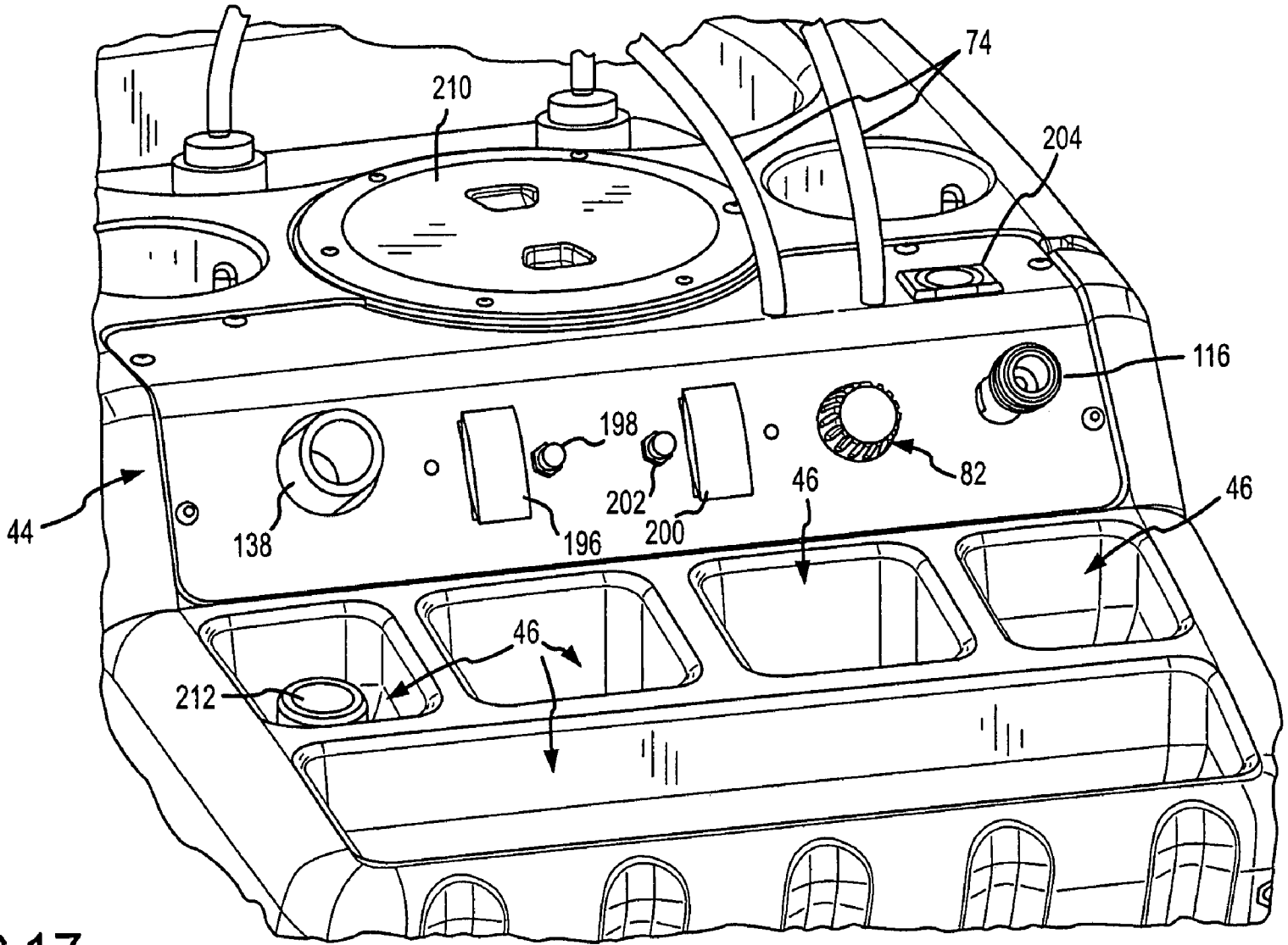
FIG. 17 is a perspective view of one embodiment of a control panel and storage bins for a preferred multi-functional cleaning machine.

Now with reference to FIG. 17, a control panel 44, storage bins 46 and the partial view of the top of the machine are generally disclosed. As can be seen from FIG. 17, the control panel 44 includes vacuum tube connection 138, vacuum switch 196, vacuum circuit breaker 198, pump switch 200, pump circuit breaker 202, chemical selector and metering valve knob 82, and high pressure hose quick connect 116. Preferably included within at least one of the storage bins 46 is a port 212 for facilitating filling of the base fluid tank 38. The port 212 preferably may extend out of the storage bin 46 for ease of use. On the top of the control panel 44 also may be found an hour meter 204, which will count the total amount of time that one or more motors or pumps on the machine 10 have operated. A recovery tank clean out and sight port 210 may also be included adjacent and above the control panel 44.

Figure 18:
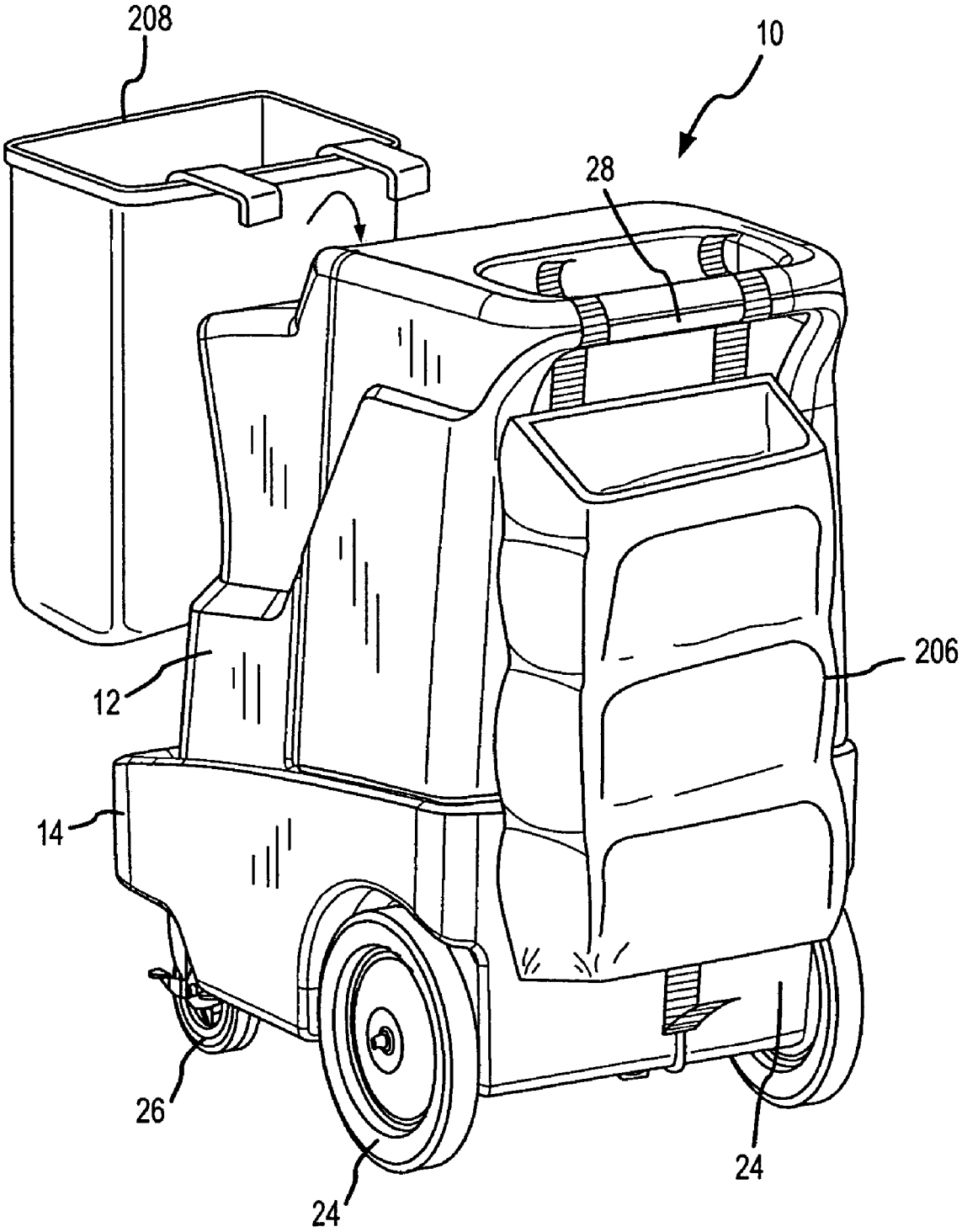
FIG. 18 is a perspective view of one embodiment of a preferred multi-functional cleaning machine showing attachment and placement of a preferred utility bag and trash/supply bin.

With reference to FIG. 18, a utility bag 206 is shown attached to the rear of the machine 10. The utility bag 206 can be made of virtually any material and configured in virtually any manner. The bag 206 may also be attached to the machine 10 in numerous known manners. In a preferred embodiment, the bag 206 is adapted to be attached to the pushing handle 28 and the base 14 using a known type of quick connect/disconnect attachment means. FIG. 18 also shows a hook-on type trash and supply bin 208 that can be attached to the front of the machine 10. Again, the trash and supply bin 208 can be attached to the machine 10 in any number of known manners.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A grout tool for use with a portable surface cleaning device, comprising:

a tool body having a front, a back, a base and a top;

one or more brushes having a proximate and a distal end, the proximate end of the one or more brushes being removably attached to the back of the tool body and the one or more brushes extending below the base of the tool body;

at least two brackets adjustably connected to the top of the tool body, wherein each bracket includes a first surface which is positioned substantially over the top of the tool and second surface which projects beyond the top of the tool body and which is angled toward the tool base; and at least one fluid jet connected to the second surface of each of the brackets.

2. The device of claim 1, wherein the fluid jets are positioned by the brackets to spray fluid beyond the distal end of the one or more brushes.

3. The device of claim 1, wherein the fluid jets are positioned by the brackets to spray fluid at the distal end of the one or more brushes.

4. The device of claim 1, wherein the fluid jets are positioned by the brackets to spray fluid into the one or more brushes.

5. The device of claim 1, further comprising at least one hose connected to each fluid jet wherein each hose is in fluidic communication with a quick disconnect coupling device.

6. The device of claim 1, further comprising a vacuum chamber defined by a first squeegee and a second squeegee positioned adjacent to a front edge of the tool body and a second edge of the tool body respectively.

7. The device of claim 1, further comprising a vacuum inlet in operative association with the vacuum chamber and adapted for connection to a suction device.

8. The device of claim 1, further comprising a plurality of squeegees connected to the tool body and adapted for contact with the surface.

* * * * *